US009086221B2

(12) United States Patent
Lona Santoyo et al.

(10) Patent No.: US 9,086,221 B2
(45) Date of Patent: Jul. 21, 2015

(54) DELTA BURNER

(71) Applicant: MABE, S.A. DE C.V., Santiago de Queretaro, Queretaro (MX)

(72) Inventors: Jose Arturo Lona Santoyo, Queretaro (MX); Ernesto Arias Del Campo, Queretaro (MX); Roberto Cabrera Botello, Queretaro (MX)

(73) Assignee: MABE, S.A. DE C.V., Queretaro (MX)

( * ) Notice: Subject to any disclaimer, the term of this patent is extended or adjusted under 35 U.S.C. 154(b) by 314 days.

(21) Appl. No.: 13/650,214

(22) Filed: Oct. 12, 2012

(65) Prior Publication Data

US 2013/0092149 A1 Apr. 18, 2013

(30) Foreign Application Priority Data

Oct. 14, 2011 (MX) ..... MX/a/2011/010941

(51) Int. Cl.

| | |
|---|---|
| ***F24C 3/08*** | (2006.01) |
| ***F23D 14/06*** | (2006.01) |
| ***F23D 14/58*** | (2006.01) |
| ***F23D 14/64*** | (2006.01) |

(52) U.S. Cl.

CPC ..... *F24C 3/085* (2013.01); *F23D 14/06* (2013.01); *F23D 14/58* (2013.01); *F23D 14/64* (2013.01); *F23D 2213/00* (2013.01); *F23D 2900/00003* (2013.01); *F23D 2900/14062* (2013.01); *F23D 2900/14064* (2013.01)

(58) Field of Classification Search

CPC ..... F24C 3/085; F23D 14/06; F23D 14/58; F23D 14/64; F23D 2900/14064; F23D 2213/00; F23D 2900/00003; F23D 2900/14062

USPC ..... 126/39 E, 39 R; 431/278, 284, 285, 354

See application file for complete search history.

(56) References Cited

U.S. PATENT DOCUMENTS

| | | | | |
|---|---|---|---|---|
| 2,311,994 | A | 2/1943 | Parker | |
| 6,315,552 | B1 | 11/2001 | Haynes et al. | |
| 6,439,882 | B2 | 8/2002 | Haynes et al. | |
| 6,655,954 | B2 * | 12/2003 | Dane | 431/354 |

FOREIGN PATENT DOCUMENTS

| | | | |
|---|---|---|---|
| JP | 11264516 | A | 9/1999 |

* cited by examiner

*Primary Examiner* — Alfred Basichas

(74) *Attorney, Agent, or Firm* — Terry M. Sanks, Esq.; Beusse Wolter Sanks & Maire, P.A.

(57) ABSTRACT

A gas burner for household may include a zone for mixing combustible gas with air to form an air-gas mixture, an inner chamber with an inner table, and including sides with crenellated walls. A vertex may be formed on each end of the sides, which may be formed by intersecting curved surfaces. A port zone may be on an upper face of the crenellated walls. The port zone includes main ports, which may be centric relative to the vertexes. The symmetry axes of the main ports may be aligned towards the vertex closest to a corresponding port. The ports may be equidistant relative to one another. A lid may close the inner chamber and pass the mixture through the ports. The curved surfaces may have different geometries. The lid may include a cavity, where another burner may be placed.

18 Claims, 29 Drawing Sheets

11
28
46
28
29
26
28
27
27
20
27

29
26
11
46
20
27

26
20
41
35
28
45
37
27
49
45
26

46
49
28
26
37
27
20
20

DELTA BURNER

RELATED APPLICATIONS

This application claims priority from Mexican Application Serial No. MX/a/2011/010941 filed Oct. 14, 2011, which is incorporated herein by reference in its entirety.

FIELD OF THE INVENTION

The present invention lies within the field of burners, particularly gas burners used in household equipment such as stoves, braziers, heaters, grills, and small furnaces or similar.

PRIOR ART

A great variety of burners for domestic or industrial use which are based on an atmospheric burner are found in the markets which use the function principles of the Bunsen burner. Initially, the main objective of these, was that of providing a flame which would have an impact on the utensils to be heated, achieving this without considering efficiency aspects of the combustibles used in the heating or aspects of ecologic character, heating speed and geometry of the kitchen utensils among others; through time the design of the burners has evolved towards the resolution of the above mentioned aspects.

As antecedents to the present invention, the applicant has knowledge of the following documents:

Document U.S. Pat. No. 2,311,994 by PARKER, describes a delta shape burner or one which can have any star shape with a plurality of points, this burner has ports set over a curve which joins the points, over a horizontal plane, said curve with ports is at a 45° angle regarding the vertical, with the purpose of projecting the flame darts towards the outside and above, further than the symmetry axis of the ports which emanates from the one point near the radius or focal of the curve on which the ports are found. According to said document, said determination for the ports' alignment was taken while considering the manufacturability of the ports, which were apparently perforated by means of bits over the curve surface of the burner, which causes a restriction of the burner's design; on the other hand, from the combustion point of view, this can cause an agglutination of flames or a dart collision given that the ports are aligned towards a common center, this leads to that in order to avoid this problem, a lesser number of ports is present, as well as a lower velocity within these, and even like this it can be seen in a maximum potency embodiment that the burner can lose efficiency given the proximity of the flames aligned towards a center which causes a tendency to collide thus provoking insufficiency of secondary air around these.

Another document worth of study is U.S. Pat. No. 6,315,552 B1 by Meier et al, which has a divisional to which number U.S. Pat. No. 6,439,882 B2 was assigned. Both documents speak of an atmospheric burner with a delta shape with ports set on the periphery on a horizontal plane, said burner contains in its interior a flow divider for combustible which itself, helps to mix the combustible with the primary air in addition reducing the flow velocity of the air mixing-combustible in order to distribute it to the star's arms or the delta (the referred to document specifies that the delta shape is only one of its embodiments). This design has the particular inconvenience of having few ports in the burner's center given the combustible flow divider; this lowers the burner's thermal potential, which has the capability of also causing slower heating for the utensils to be heated, knowing that heating kitchen utensils as close to the center as possible is desired, which aids in better heat diffusion to the base of the utensil, thus homogenizing temperature on the cooking surface of the utensil. Said design fails to provide a solution to this need of the operator's, as it places the majority of the ports on the points of the stars or delta, thus concentrating more flame darts as far away from the burner's center as possible, heating more towards the outer periphery of the heating surface of the kitchen utensil, leaving the center "cold", thus causing temperature gradients on the cooking surface of the kitchen utensil, such as a crown or circular atmospheric burner like the ones traditionally found on cooking equipment or stove would do.

Japanese publication number 11264516 makes known an equilateral triangle shaped burner. In this publication, the burner sides are totally straight, so that it does not cause the flames to have a substantially centric incidence point conforming to the utensil to be heated.

In this manner, this and other differences regarding prior art shall become evident when reading the detailed description of the present invention.

BRIEF DESCRIPTION OF THE INVENTION

The burner of the present invention has a non-conventional shape for a burner. Traditionally, atmospheric Bunsen burners for stoves are circular crowns. Alternatively, one can find star shaped burners in the market made of perforated steel tubes which are used to heat large containers. In this way, these star, triangular or delta shaped burners attempt for the flame darts to cover a greater contact area of the lower area of a utensil to be heated, where the flame darts are distributed in a homogenous way over the entire lower area of the utensil to be heated. It is also desirable to have flame darts near the surface to be heated, and above all, near the center of this, as well as also desiring a compact sized burner so that it may be more flexible, as it can be of service to a great variety of differently sized utensils. Additionally, it is also desirable to have a powerful burner to be able to heat.

In order to solve the above mentioned problems and which were detected by the inventors of the present invention, a burner with a shape similar to a delta or similar to a triangle is provided whose cathetus or sides are formed by the intersection of two curves, a first curve over a horizontal plane joining the points or vertexes thus projecting the wall over which the ports are on its upper edge (as in a crenellated wall), this will intersect with a curve surface preferably a truncated cone or in an alternative embodiment it may follow a sphere or dome shape. This interesting arrangement allows for the possibility of having more ports on a smaller sized burner as well as placing ports as close to the center of the utensil to be heated both on a horizontal plane as well as on the vertical plane; it should be noted also that the direction of the ports is "outwardly" directed or they tend to open in relation to the burner and as such, do not coincide in the center, which allows for better aeration, which results in improved combustion.

BRIEF DESCRIPTION OF THE DRAWINGS

The particular characteristics and advantages of the invention, as well as the other aspects of the invention, shall become apparent from the following description, taken along with the accompanying drawings, from which.

DETAILED DESCRIPTION OF THE INVENTION

Definitions

The term "approximately" can be defined with a specific range. For the purposes of the present invention, the range given through the term "approximately" is ±10%. That is, if the range is defined approximately "1 to 25". The interpretation which should be applied to said range in conjunction with the term "approximately" would be any of the following combinations: 0.9 to 25, 1.1 to 25, 1 to 27.5, 1 to 22.5, 0.9 to 27.5, 0.9 to 22.5, 1.1 to 27.5 or 1.1 to 22.5.

Figure 1:
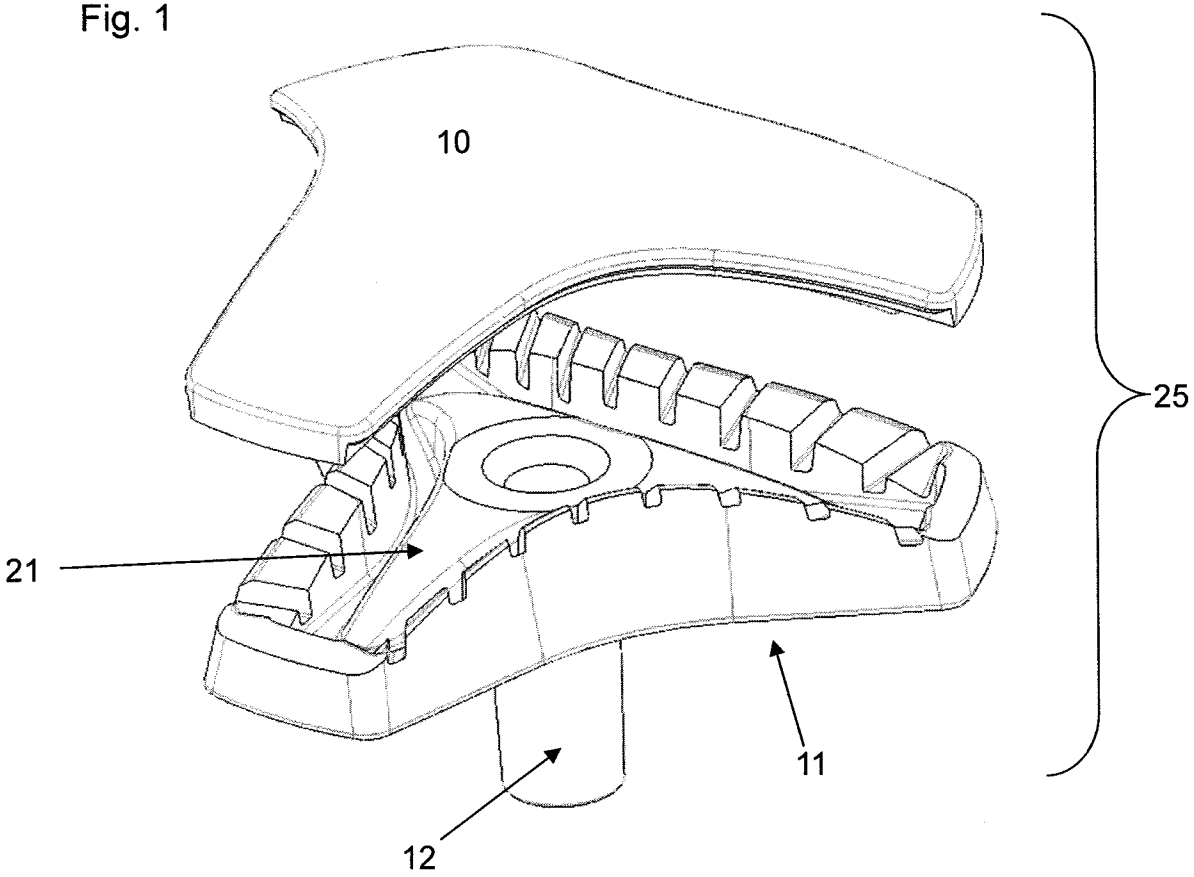
FIG. 1 is a perspective view and an exploded view of the burner of the present invention.

FIG. 1 shows an exploded view of the preferred embodiment of the present invention, which comprises a burner body 11 which in its interior has a platform 21, a Venturi tube 12 through which the mixture of gas with primary air enters, and a lid 10 which covers the upper part of the body of the burner, which comprises the burner 25 of the present invention.

Crenellated Wall 26

Figure 2:
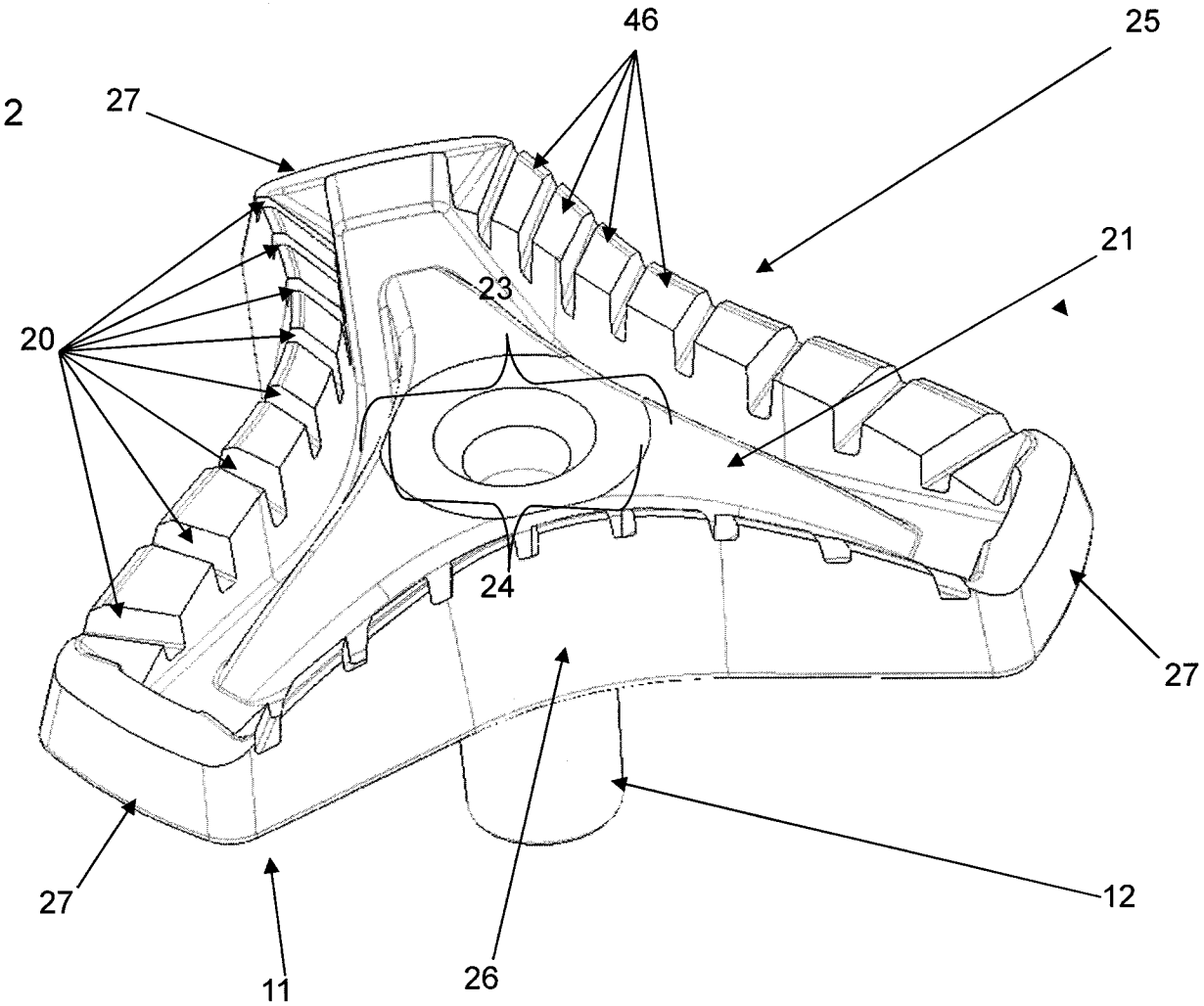
FIG. 2 is a perspective view of the burner of the present invention, without the lid.

FIG. 2 shows and allows the study of the body of the burner 11 which we submit for study given its particular construction, design and geometry. The referred to body of the burner 11 is formed by a wall or crenellated wall 26 which is constructed by the at least two curved surfaces which intersect on at least two planes. Over the horizontal plane, a curved surface is sketched in a domed, spherical or any other curved shape, which is intersected on the vertical plane by a curved surface preferably a truncated cone or in an alternative embodiment in similar manner a domed, parabolic, or another. So that from the intersection of said curves a wall 16 is formed which is later crowned with crenellations 46.

Figure 3:
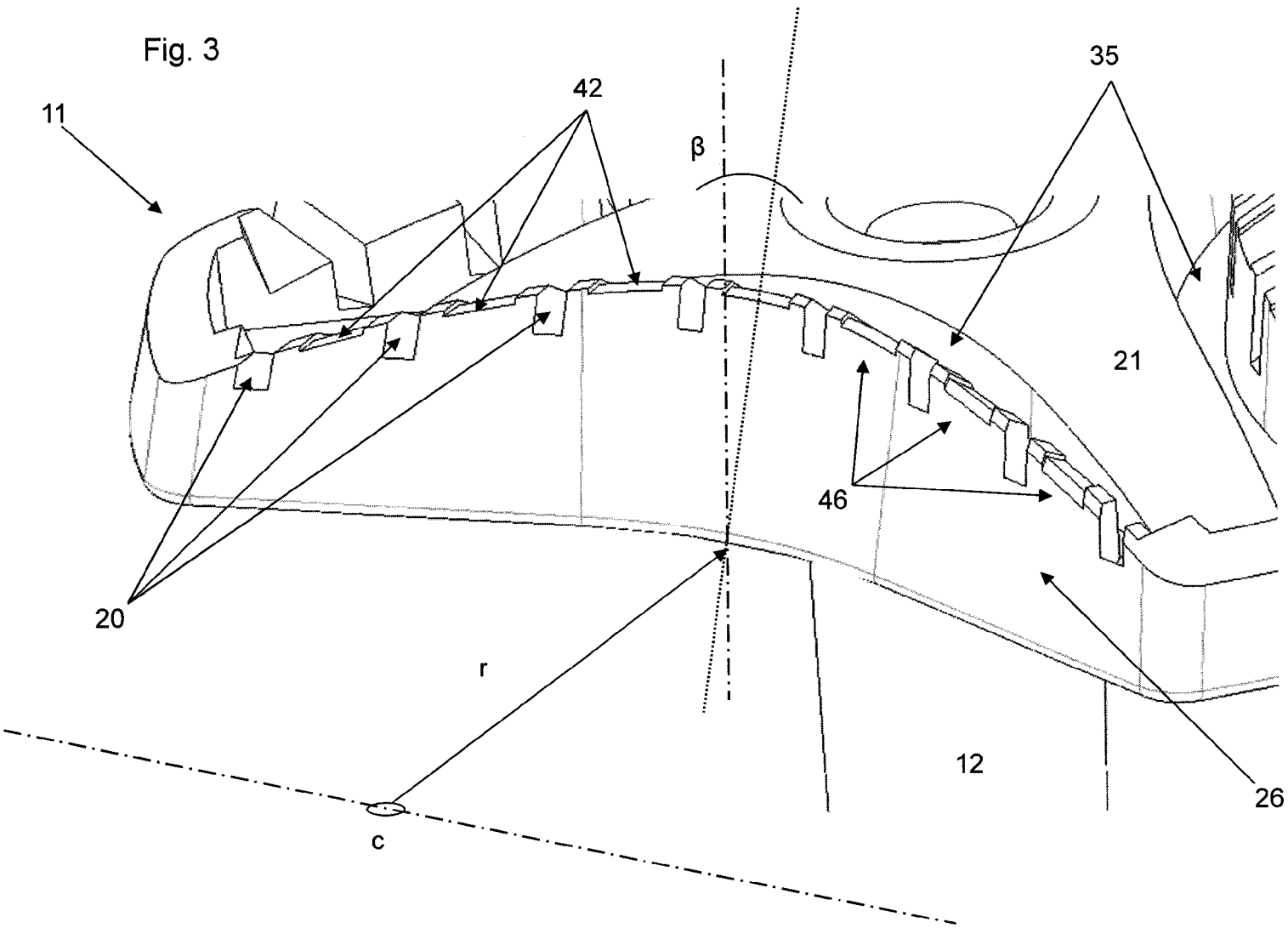
FIG. 3 is a conventional perspective view of a detail of the ports of the burner of the present invention.

This can become more clearly apparent upon the study of FIG. 3, where there is a center c from where a horizontal plane is sketched over which we project a radius r through which the vertical curved surface passes through which as previously outlined may follow a curvature in a manner similar to a cone, a parabolic or a curve. Said vertical curved surface has a β inclination measured from the vertical, said β angle can vary between approximately 1° and 25° which shall depend on the particularities of the design, de-molding parameters, measurements and proportions, among other variables as well as considerations involving the body of the burner 11 in particular.

In this way, when this vertical surface intersects a curved surface sketched over the horizontal plane (which can be a truncated cone, a dome, a sphere, a parabolic among others) with a phase shifting or a displacement over said horizontal plane a wall or crenellated wall 26 is formed at a height which follows a curve. Said wall or crenellated wall 26 is crowned with crenellations 46, which help form the ports 20. These mentioned walls or crenellated walls 26 are joined by means of vertexes 27 such as are shown in FIG. 2. In an alternative embodiment a burner can be conceived which contains at least two vertexes 27 and a single crenellated wall 26 joined to any other geometry by means of the vertexes 27, such as could be an oval or semi-circular type burner, among others.

Body of the Burner 11

The body of the burner 11 can be glimpsed at in FIG. 2, which as was described in detail previously is preferably formed by at least three crenellated walls joined by at least an equal number of vertexes 27 which results in a substantially polygonal surface preferably in a triangular or delta shape manner, the substantially polygonal shape can vary depending on the number of crenellated walls 26 and vertexes 27 which are used for the construction of the body of the burner 11 periphery.

Figure 4:
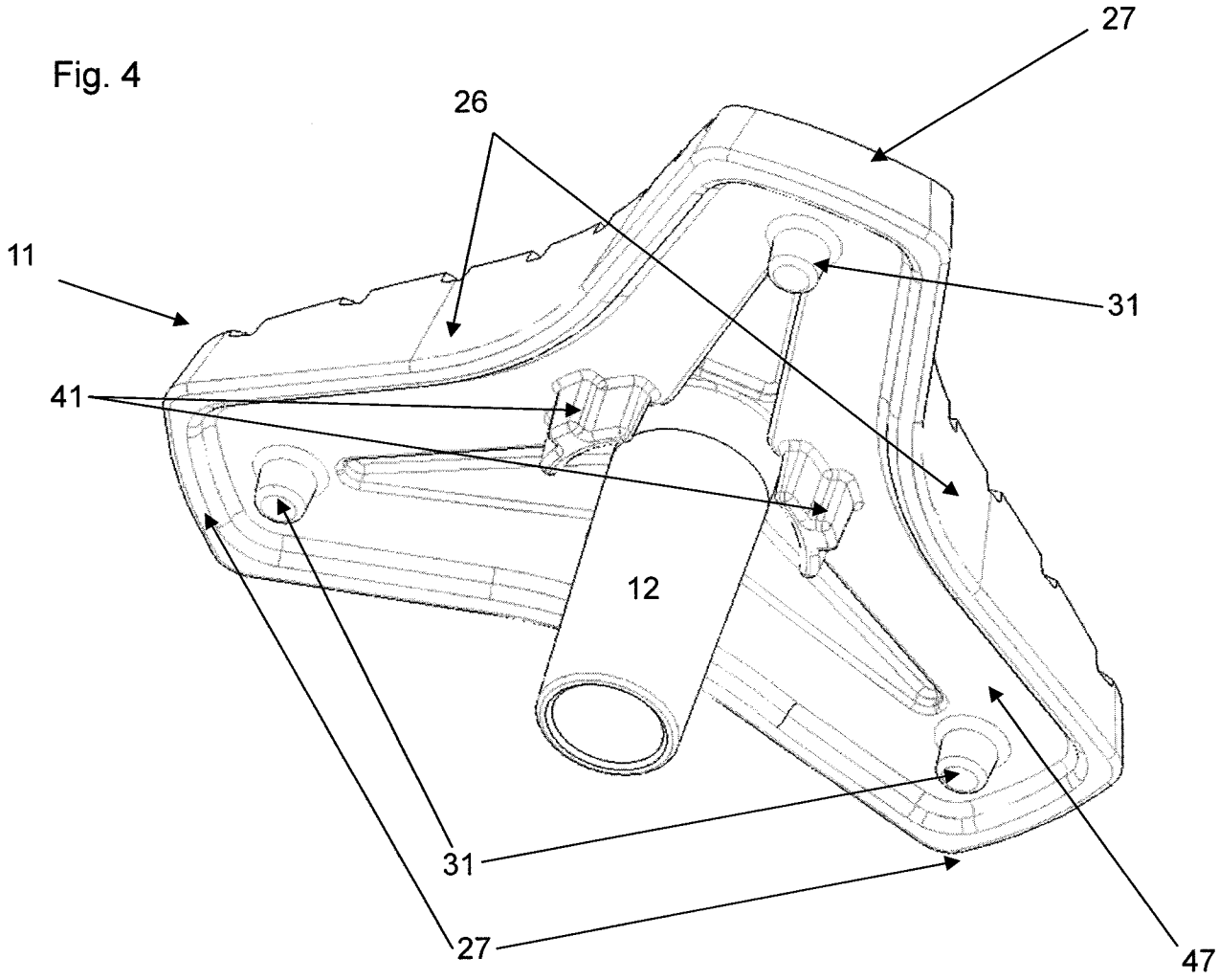
FIG. 4 is a lower conventional perspective view of the burner of the present invention.

Thus having the body of the burner 11 periphery ready, we now turn to FIG. 4, where the flooring for the body of the burner 11 can be seen, which joins the crenellated, walls 26 as well as the vertexes 27. It also can be seen that the referred to flooring 47 houses the Venturi tube 12 which is preferably found in close proximity to the center of the polygon formed by the crenellated walls 26 and vertexes 27.

Figure 14B:
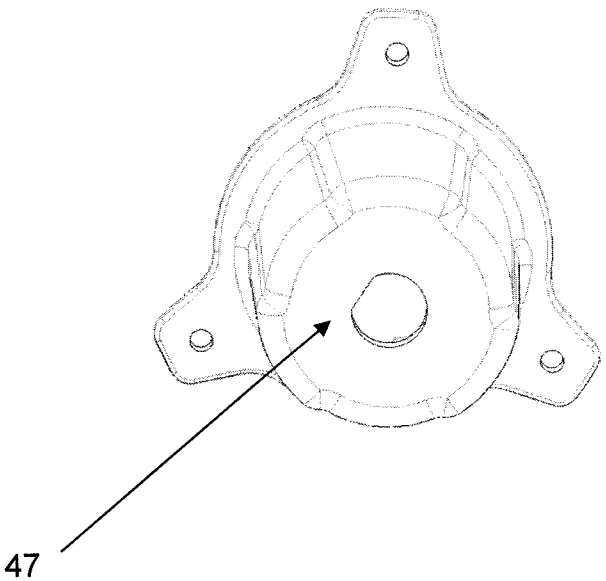
FIG. 14*b* shows a conventional perspective lower view of the body of the burner of the present invention.
Figure 14A:
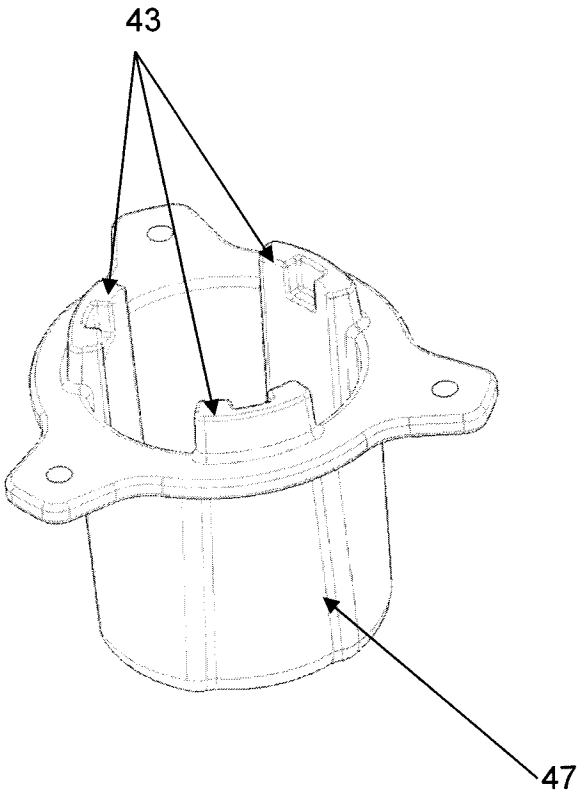
FIG. 14*a* shows a conventional perspective upper view of the body of the burner of the present invention.

The extremities 41 set around the Venturi tube 12 should be highlighted, which are nestled over the centering ribs 43 with which the cup 17 is crowned with (see FIGS. 14*a*, 14*b*). The positioning system which comprises the extremities 41 with the centering ribs 43, may be set as "poka Yoke", that is, they may have a set separation or a specific configuration which only allows its assembly in one way, and through this avoiding the body of the burner 15 from being incorrectly placed over the cup 17.

Now, additionally the legs 31 can be seen which are set more or less under the zone of the vertexes 27, said legs 31 help separate the burner from the stove's cover or over the diffuser plate 18, as a distance "v" exists between said plate and the lower surface of the body of the burner 11 (see FIG. 18), so that the primary air may circulate underneath the body's burner 11 towards the cup 17 (a mechanism which shall be discussed later).

Thus, turning our attention back to said FIGS. 2, 3, we highlight the platform, which towards its central part houses the discharge zone 24 through which the mixture of combustible air exits-air transported through the Venturi tube 12. Said combustible air-air once it passes through the discharge zone 24 arrives at the mixture chamber 23 where it completes the action of mixing the combustible with the air. Thus said mixture chamber 23 is bound by the circumference area formed between the tangential points which are formed between the curved surface of the inner wall of the crenellated wall 26 and whose center coincides with the symmetry axis of the Venturi tube 12. The referred to platform's 21 geometry has a peculiar geometry, knowing that, said platform 21 is also a product of the curved surfaces which are intersected, in this case there is a curved surface with a shape similar to that of a dome, sphere, parabolic, among others, formed over a horizontal plane, which is cut on one of its sides by at least one curved inner surface which forms a crenellated wall 26; with such luck that depending on the number of crenellated walls 26 and vertexes 27 which the body of the burner 11 comprises, the platform 21 follows the quasi-polygonal shape which forms the referred to periphery of the body of the burner 11. To achieve a better distribution of the combustible mixture-air inside the burner's chamber 25, a channel 35 has been provided (see FIGS. 5, 6, 9*a*, 9*b*, 10) which runs adjacent and parallel to the inner wall of the crenellated wall 26, thus separating said inner wall from the crenellated wall 26 of the platform 21 which forms the periphery of the platform 21.

Ports and Crenellations

Turning our attention to the crown of the crenellated wall 26 (FIGS. 3, 5, 6, 7*a*, 7*b*, 9*a*, 9*b*, 10, 11*a*, 11*b*) we highlight the ports 20 and the crenellations 46. The crenellations 46 on their upper part sustain the lid 10 which covers the body of the burner 11, where the sides of the crenellations together with the lid 10, function as the frame of the ports 20. It should be mentioned that in an alternative embodiment secondary ports 42 can be set on the crest of the crenellations 36, which may aid in the transport of the flame between the main ports 20, in addition to increasing the burner's 25 thermal potential. The main ports 20 set over the crenellated wall 26, have a peculiar geometry, knowing, that the base of the referred to ports has an angle α from the horizontal (see FIGS. 5, 6), which oscillates between approximately 10° to 60°; the referred to angle α allows for the directing of the flame's dart towards the outside and above, achieving through this a flame which attempts to have the greatest contact area with the utensil to be heated, as well as an efficient combustion dart. The lateral walls of the ports 20, as well as those of the crenellations 46 are preferably parallel, although in an alternative embodiment of the ports' cross sections; one can envision any geometrical shape such as circular, elliptical, triangular, trapezoidal, polygonal, etc. where a charge of the ports are maintained between 15,000 to 30,000 Btu/(h in2) where the charge on the port is understood as the thermal potential between the total port area Cp=IR/At, Where:

Cp=charge on the port

IR=thermal potential (input rate)

At=total port area

Thus for the preferred embodiment of the present invention ports with a rectangular, square or trapezoidal cross section shall be used, noting that in an alternative embodiment, any alternative geometry may be used.

Figure 6:
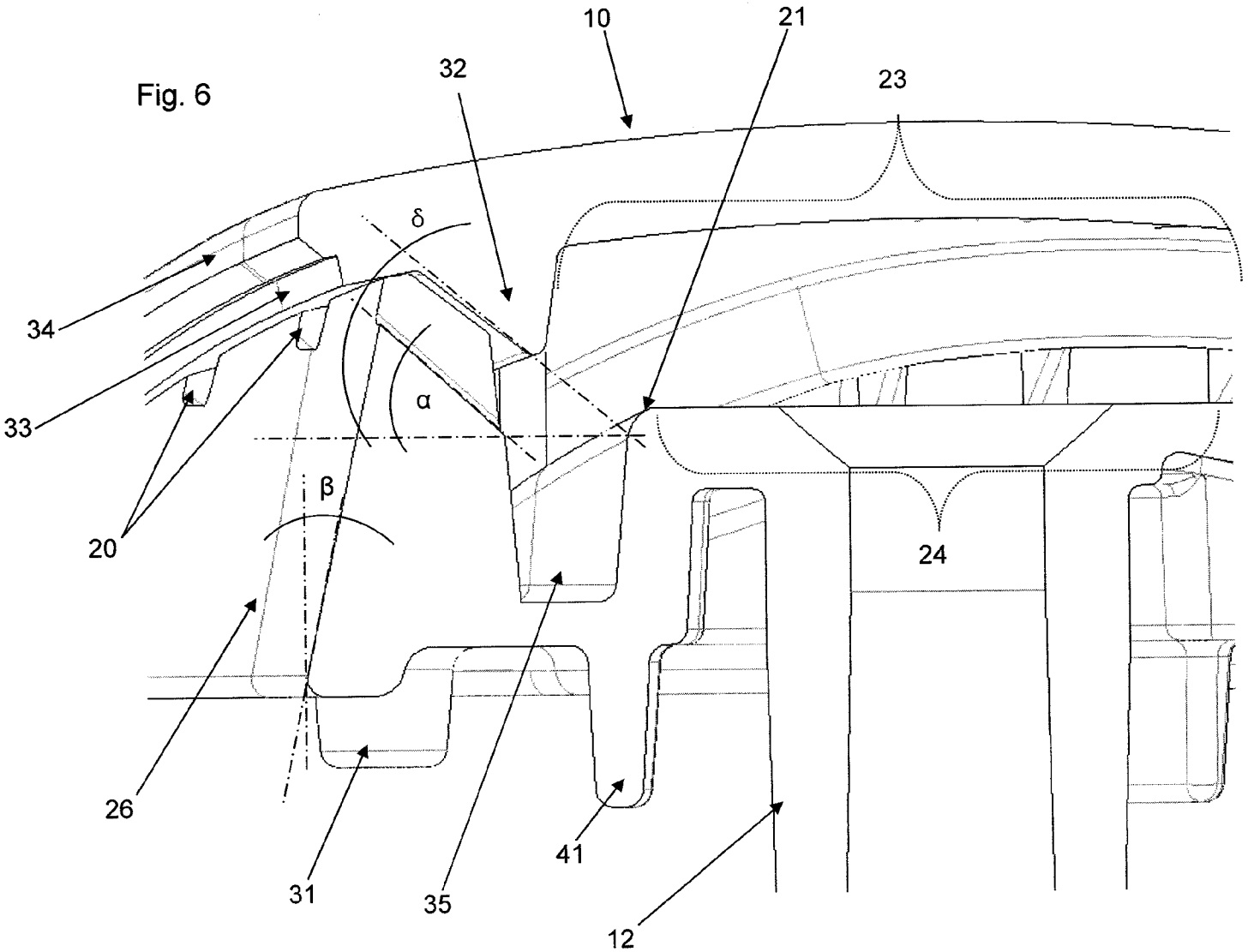
FIG. 6 is a cross section view of a detail of the burner of the present invention.
Figures 7A, 7B:
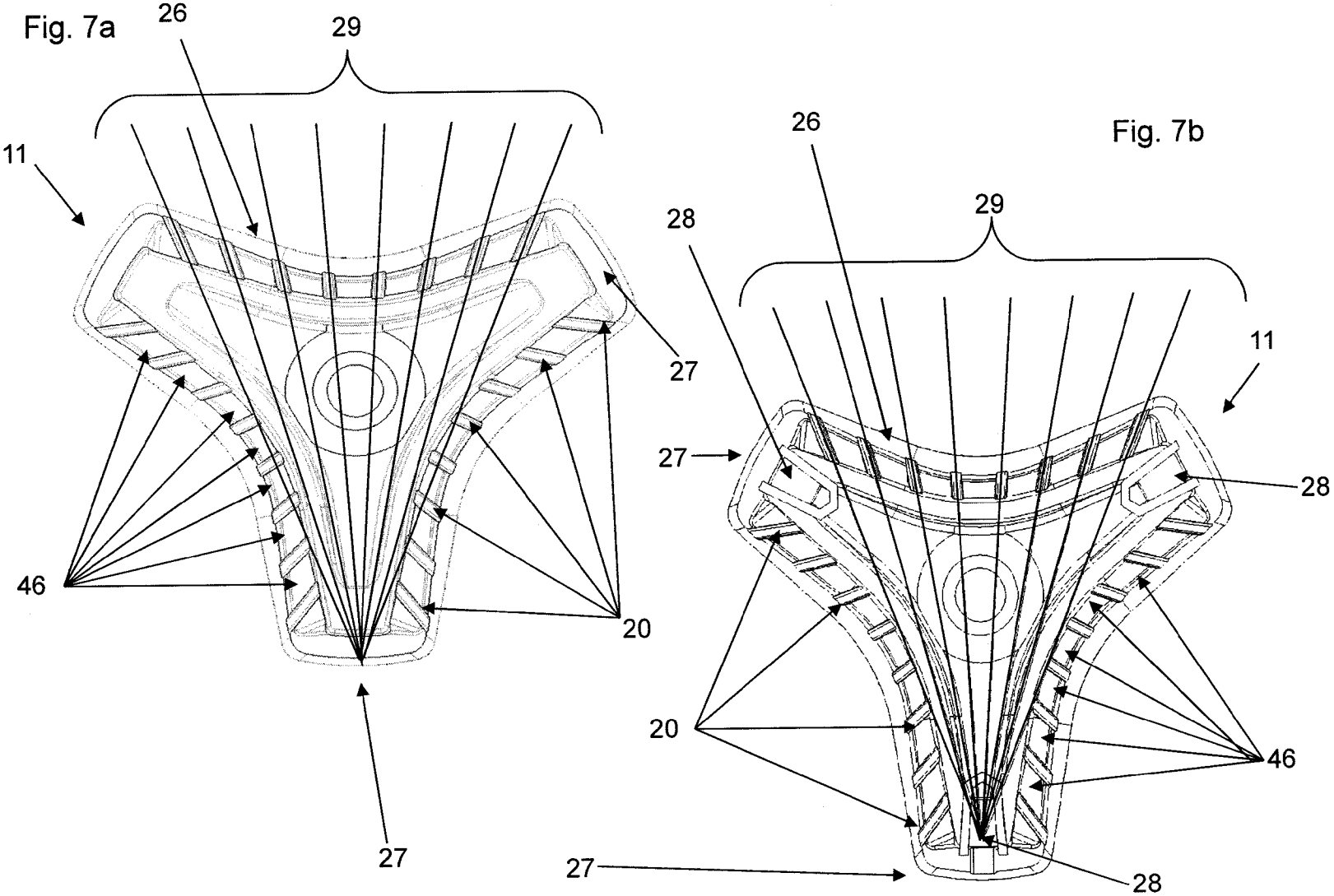
FIG. 7*a* is an upper view of the burner of the present invention.
FIG. 7*b* is an upper view of a first embodiment of the burner of the present invention.
Figures 8A, 8B:
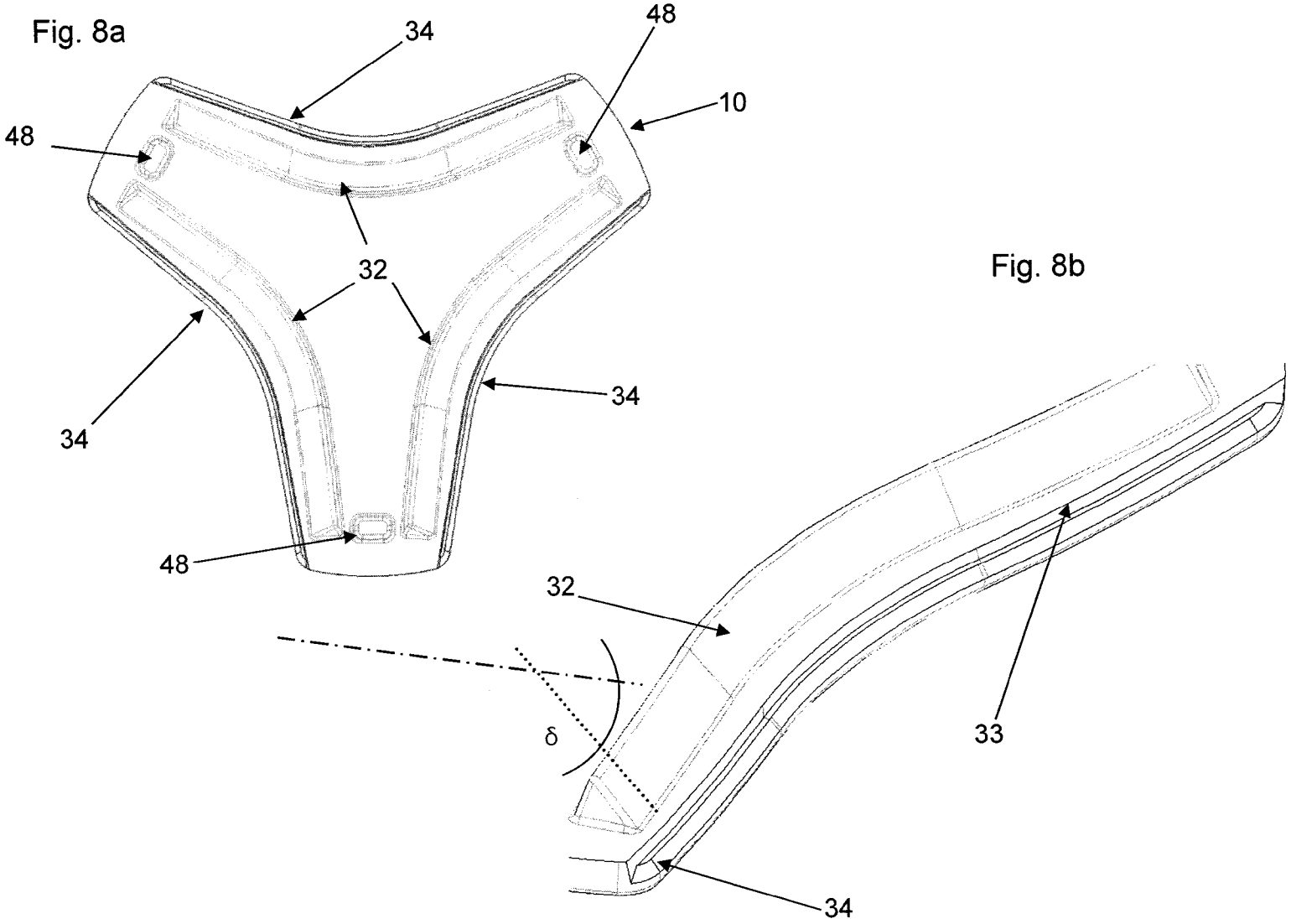
FIG. 8*a* is a lower view of the burner of the present invention.
FIG. 8*b* is a lower view of a detail of the burner of the present invention.
Figures 9A, 9B:
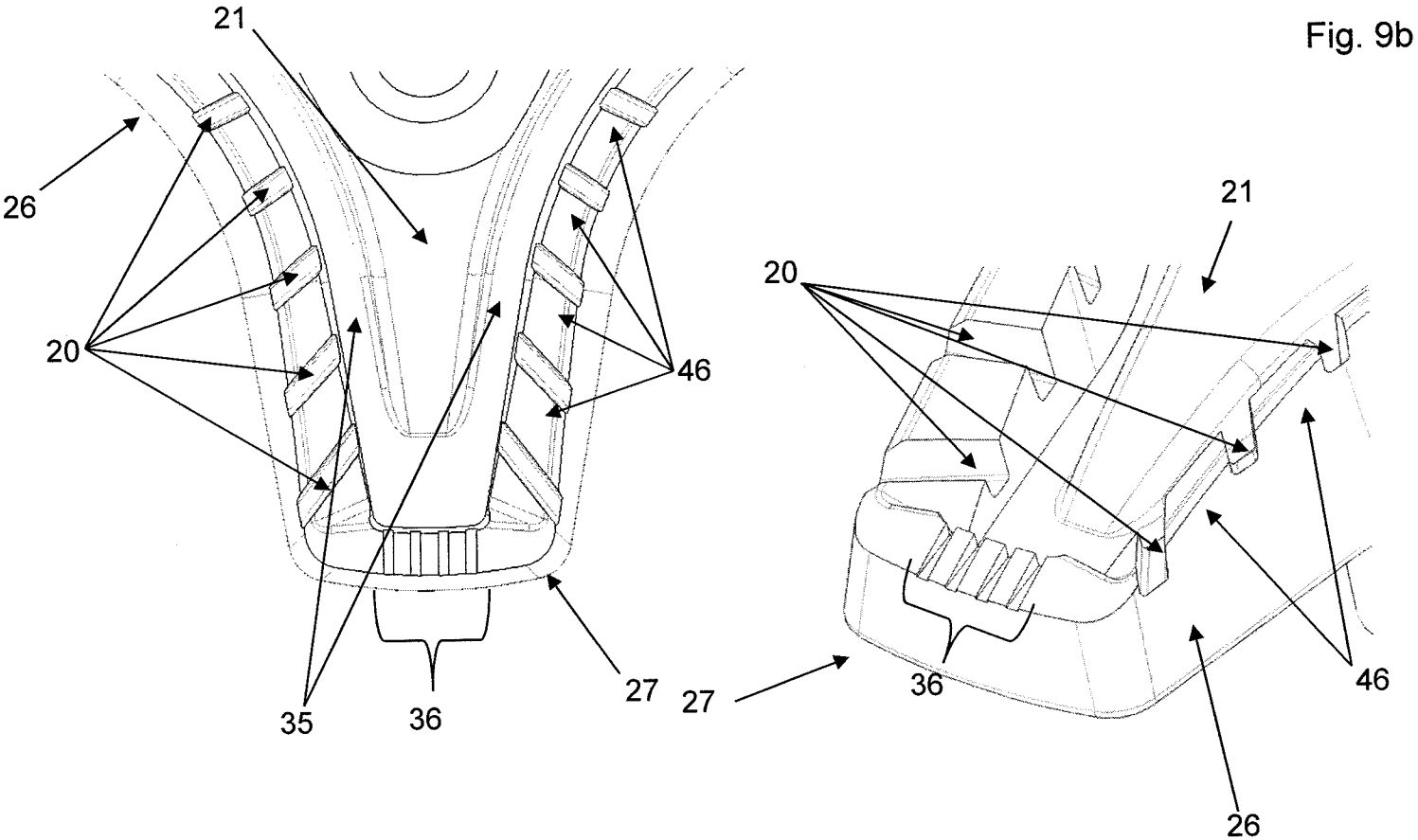
FIG. 9*a* is an upper view of one of the ends of the burner of the present invention, in a second embodiment.
FIG. 9*b* is a conventional perspective view in detail of the ends of the burner in the second embodiment of FIG. 9*a*.

Thus the duct of the port 20 is covered in its upper part by the rib 32 of the lid 10; the referred to rib 32 is found on the lower face of the lid 10 (see FIGS. 6, 8*a*, 8*b*). Said rib 32 similarly to the upper inner apex of the crenellations 46 has an angle ð from the horizontal, said angle ð oscillates between approximately 10° and 60° and may differ or be the same as angle α from the base of the port's 20 duct, this shall depend on the parameters of the design such as; de-molding mechanism, manufacture criteria, combustible type and atmospheric height at which the burners 25 functions, among other design considerations. In the preferred embodiment of the invention, the angle δ varies approximately between 1° and 10° to the angle α, this with the end purpose of creating a cone or of allowing the duct to have an exit port area lesser than the entry port area (both are at the ends of the duct port), which aids in increasing the velocity of the particles in the combustible-gas mixture which circulate through said port duct, with which the designer can achieve a better maneuver margin to attain the desired length and shape of flame darts.

It should be highlighted at this point that the peculiar setting of the ports allows there to be sufficient space between these so that they not collide or that they not combine allowing for proper secondary aeration. This can be seen in greater detail in FIGS. 7*a* and 7*b*; said figures highlight in a didactic manner a set of symmetrical axes 29 which cut the ports in half, it should be noted that these have their origins near or in close proximity to the vertex 27 on the horizontal symmetrical axis which exists between the center of the Venturi tube 12 and the very center of the vertex 27 itself, the exact location of the referred to origin shall be determined depending on the burner's size, the number of ports, the thermal potential and the geometry of the ports themselves, among other particulars to be considered. As can be noted, the axes 29 depart from an origin and diverge along their length, growing along the body of the burner 11; thus, when they intersect the crenellated wall 26, these already have sufficient equidistant space between them, thereby creating ports with the correct distance between them. Additionally, given their alignment "towards the outside" and not "towards the point of origin" the possibility of their colliding or congregating at a flame dart point is eradicated.

Lid Geometry

In FIG. 1 the particular design of the lid 10 which is placed over the body of the burner 11 can be seen. The lid 10 along with the inner part of the body of the burner 11 forms a chamber where the final mixing of the combustible air takes place, in addition to providing said mixture to the ports 20 along the length of the inner wall of the crenellated wall 26 and the channel 35. Thus the height between the upper surface of the platform 21 and the lower surface of the lid 10 is an important one, this being one among several of the reasons as to why the lid 10 also has a part of the geometry between a curved surface on the vertical plane, where said curved surface may be a dome, sphere or parabolic among others. Thus this curved surface is cut by another curved surface on a horizontal plane, which itself is a very similar curve to the one used to form the crenellated wall 26, since the lid 10 covers and be seated on said crenellated wall 26, so that following its contour is important; and in that same vein, the lid 10 follows the contour of the periphery of the body of the burner and as such, its geometry shall determine the lids' contour 10.

FIG. 8*a*, shows a lower isometric view of the lid 10, where the ribs 32 which rest on the crenellations 46 of the crenellated wall 26 can be discerned, themselves closing the port duct's 20 upper side. Additionally the ingots 48 which form part of an alternative embodiment of the lid 10 of the present invention can be seen, which allow for positioning or aid in the correct placement of the lid on the body of the burner 11, as said ingots 48 bump against the vertexes 27 of the body of the burner 11; in a preferred embodiment of the invention the use of said ingots 48 is waived.

It should be mentioned that the lid 10 in an alternative embodiment may be grasped to the body of the burner 11 by means of screws, rivets, fasteners or any other means fastening.

FIG. 8*b* aids in discussing the lid's 10 bevel 33 and extremity 34, which are set close to or on the edge or on the border of the lid in a substantially parallel to the rib 32 manner. The bevel 33 is a recess forms on the top of the lid 10, to later be followed by the extremity 34 which may be rounded. The discussed bevel 33 and extremity 34 arrangement aids in the formation of the flame dart granting it improved appearance and stability.

FIGS. 16, 18, 19*a*, 20, 23*a*, 23*b*, 23*c*, show alternative embodiments of the lid 10, which may be set with a cavity in its central part, which allows for the placement or allows for the passage of a central burner in this place, this with the end purpose of being able to grant a greater thermal potential to the burner 25, as well as having dart flames nearer to the center of the utensil to be heated, or even a low capacity and high pressure central burner 39 independently controlled from the body of the burner 11. The cavity may have almost any shape, a circumference or polygonal shape which follows the contour of said lid 10 being preferable. In any case, it is preferred that the above mentioned cavity have a separator ring 38 which takes off, separates or raises the central burner 39 from the lid's 10 upper surface at a distance "h" which preferably oscillates approximately between 1 mm to 25 mm. If said distance "h" does not occur, the flame darts would have to "be dragged" over the lid's 10 upper surface given the "capacity limit" effect between said upper surface of the lid 10 and the flame darts. Thus, upon raising the central burner one avoids this problem since better defined dart flames are obtained, coupled to also achieving better secondary aeration of the central burner.

Diffuser Plate 18

Figure 13B:
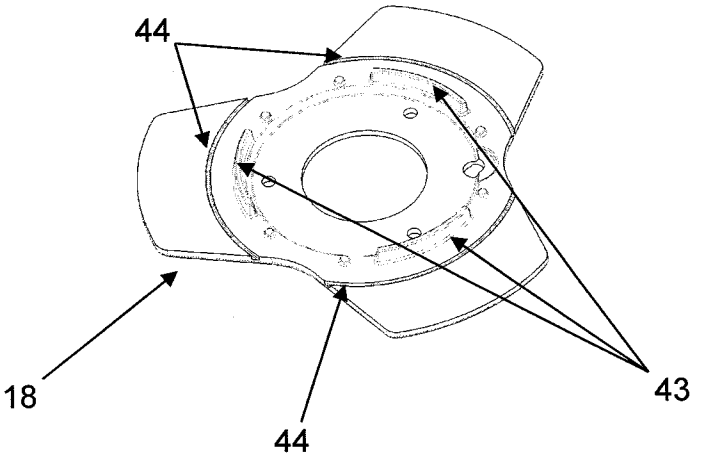
FIG. 13*b* shows a second embodiment of the diffuser plate of the burner of the present invention.
Figure 13D:
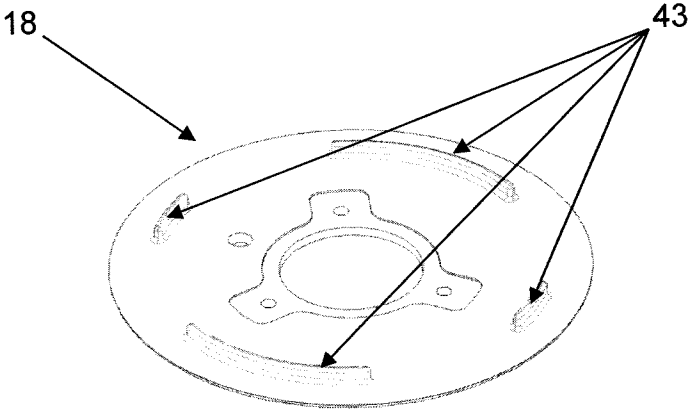
FIG. 13*d* shows a fourth embodiment of the diffuser plate of the burner of the present invention.
Figure 13A:
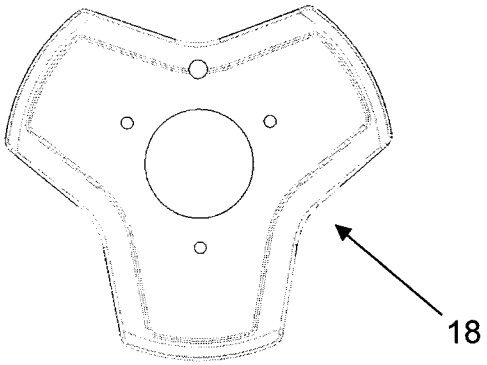
FIG. 13*a* shows a first embodiment of the diffuser plate of the burner of the present invention.

FIGS. 13*a*, 13*b*, 13*c*, 13*d* show two preferred embodiments of the diffuser plate 18, FIGS. 13*a*, 13*b* show a plate's geometry in a substantially triangular or delta shape in such a way that it mirrors the contour of the body of the burner 11. It should be highlighted at this point that the diffuser plate 18 may follow or mirror the polygonal or periphery shape of the body of the burner 11, the plate having a larger area in its upper part than that of the lower face 47 of the body of the burner 11. The diffuser plate 18 in any of its embodiments is set with a substantially central hole through which the Venturi tube 12 of the body of the burner 11 passes. In a satellite manner to the hole, a plurality of holes is set through which the fastening means passes through which are to join the diffuser plate 18 to the cup 17. In this way both embodiments are set with a plurality of centering ribs 43 which help center the diffuser plate 18 in the cavity set on the stove's or kitchen's cover 19 where the burner 25 will be lodged. From FIG. 13*b* a series of radial channels 44 can be seen on a same diameter, where said channel is sufficiently deep to house a seal ring, closure, seal or packaging which will absorb impacts and vibrations, since there are some embodiments of stove or kitchen covers 19 made of glass or ceramic material, which have low resistance to impacts, the above mentioned O-ring avoids the passage of fluids emanating from a spill of the utensil to be heated, thus preventing said fluid from pouring towards the inner part of the cavity where the burner 25 is placed on the cover 19: in this way between the said kitchen or stove cover 19 the diffuser plate 18 is placed directly on it, being apparent that this itself supports the rest of the burner 25.

Figure 13C:
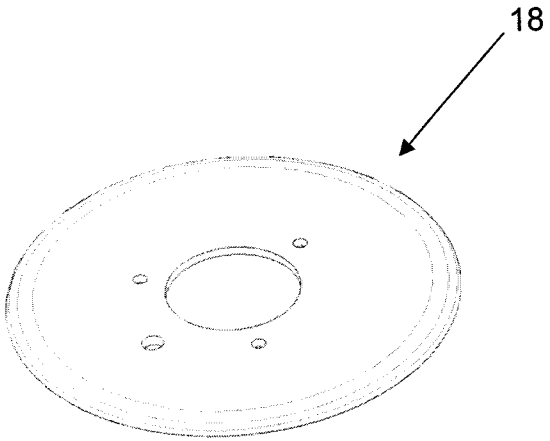
FIG. 13*c* shows a third embodiment of the diffuser plate of the burner of the present invention.

FIGS. 13*c*, 13*d*, show an alternative embodiment of the diffuser plate 18 which has a cylindrical shape; in both cases or embodiments, the diffuser plate 18 has its extremities, borders or ends rounded or chamfered, as they should not have a sharp edge, border or sharp parts, for the operator's safety reasons as well as for aesthetic reasons.

The use of a diffuser plate 18 in the burner's 25 assembly of the present invention is an alternative embodiment, if the said diffuser plate 18 serves as resistance, shield or thermal barrier preventing the heat emanating from the burner from passing directly to the kitchen or stove's cover surface 19, which as was discussed in the above lines can be made of a glass or ceramic material, is not necessary when the cover 19 is made of a metallic material such as steel. Thus, the diffuser plate 18 creates a temperature gradient, and furthermore, grants rigidity to the burner 25 in addition to support by distributing the weight of it over a larger area through which mechanical forces on said kitchen or stove cover 19 are reduced to a great degree when it is made of a glass or ceramic material. Said plate 18 is preferably manufactured of a metallic material such as steel, aluminum or alloys of the same. In another preferred embodiment when the cover 19 is made of a glass or ceramic material, a lower plate 53 is used which is grasped unto the cup 17 (the cup assembly with the lower plate 53 is detailed in the chapter "Aspiration Mechanism, mixture and distribution of mixture in the burner's chamber and stability chamber" of the present document), said lower plate 53 acts in conjunction with the plate 18 confining the cover 19. It should be mentioned that the lower plate's 53 extremities, which contain rubbers 54, are resilient, with such luck that upon confining the cover 19 between the plate 18 and the lower plate 53, said rubbers 54 make contact with the lower face of the cover 19 thus flexing the resilient extremities which contain them upon adjusting the fastening means which join the plate 18 to the cup 17, grasping unto the cover in a clamp manner.

Figure 12:
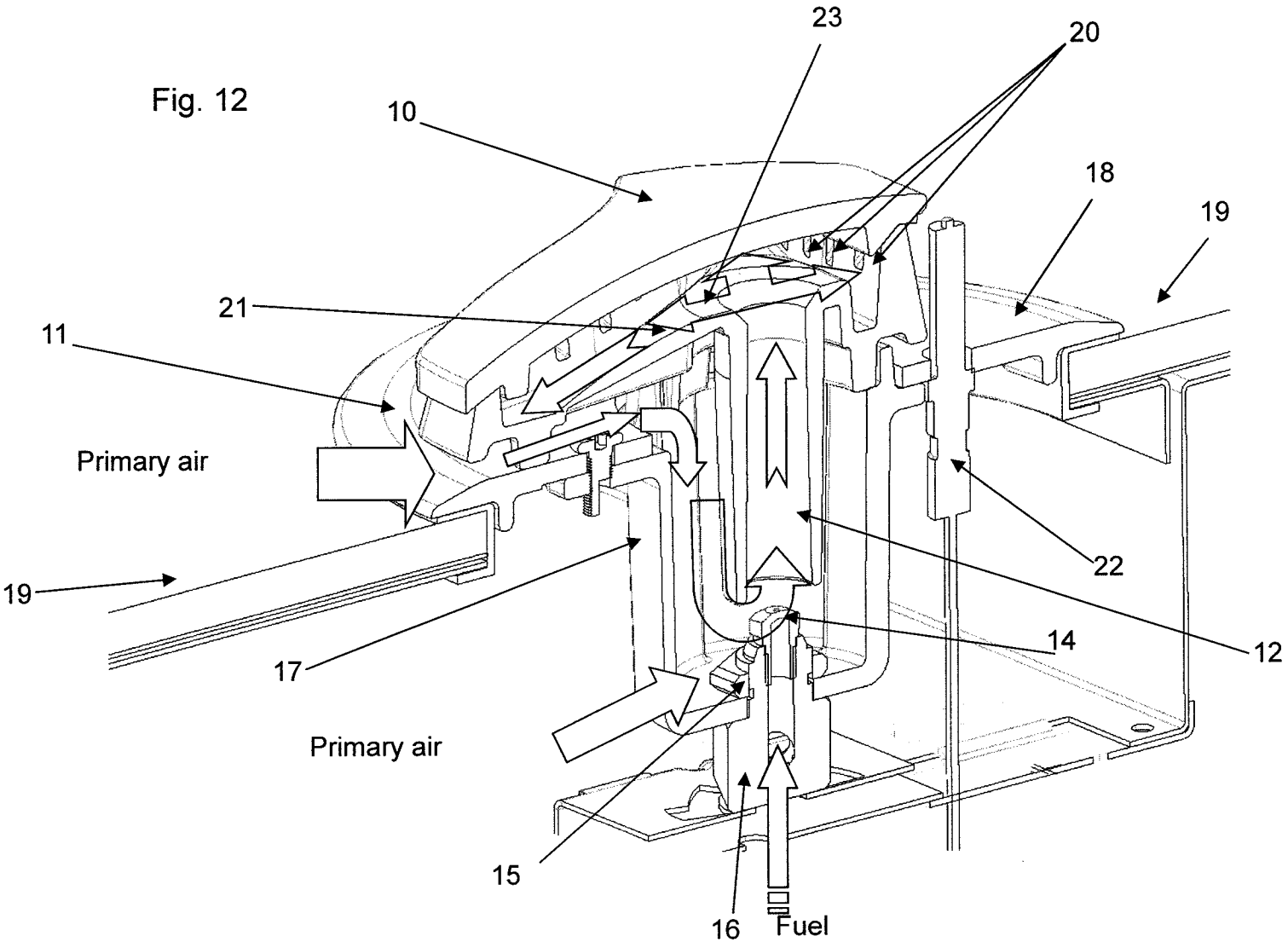
FIG. 12 is a cross section view of the burner of the present invention showing the fluid flow in the burner.

Aspiration Mechanism, Mixture and Distribution of Mixture in the Burner's Chamber and Stability Chamber FIG. 12 shows a cross cut of a burner's system of the present invention mounted on a kitchen or stove 19 surface. As was previously mentioned, a diffuser plate 18 or a lower plate 53 can be used or not used, depending upon the material employed for the kitchen or stove 19 cover. In this way, underneath the body of the burner 11 or said diffuser plate 18, a cup 17 is grasped by means of screws or any other type of assembly (see FIGS. 12, 14*a*, and 14*b*) which itself supports. Said cup 17 in its lower part houses the mini-connector 15 which itself houses a nozzle 14, which then provides and directs the combustible towards the Venturi tube 12. Precisely between the lower part of the Venturi tube 12 and the upper face of the nozzle 14, there is a space which allows the passage of primary air to the Venturi 12, it is at this point where the burner system extracts the primary air, which is mixed in the burner's interior 25. In a preferred embodiment said primary air enters under the body of the burner 11 and is transported towards the cup 17 to later be suctioned by the Venturi tube 12, this embodiment is particularly useful when the burner 25 is placed on a kitchen or stove which has an oven because the combustion gases as well as the hot and contaminated air from the oven is not aspirated by the burner 25. In another alternative embodiment grooves or windows 50 are set on the lower part of the cup 17 (see FIGS. 12, 15*a*, 15*b* and 15*c*) to achieve aspiration of the primary air precisely in the zone adjacent to the nozzle 14. In this way, we have double aspiration both under the body of the burner 11 as well as under the cover for kitchen or stove 19. The windows 50 on the lower part of the cup 17 allow the mass flow of primary air regulating the primary air surrounding the lower outer part of the cup 17, toward the inner part of the cup 17, allowing for said primary air to be dragged with an adequate quantity, acceleration and velocity towards the Venturi tube 12 and the nozzle 14. This mechanism allows the aspiration of the primary air with greater ease of the burner 25, knowing that the mass flow of primary air aspirated through the windows 50 as well as preventing the turbulence which could be created in the trajectory in the situation where it is only aspirated underneath the body of the burner 11. This embodiment is peculiarly conducive when the kitchen or stove unto which the burner 25 has been mounted does not have an oven on its lower part. It should be highlighted that in any embodiment of primary air aspiration, the cup 17 allows the control of air flow towards the Venturi tube 12, even when strong air currents exist on the surface. Another embodiment of the cup 17 exists when the windows are very large 50, with such luck that it is transformed into a "spider" type support allowing free passage without any regulation of the air towards the aspiration mouth of the Venturi tube 12.

Figure 15B:
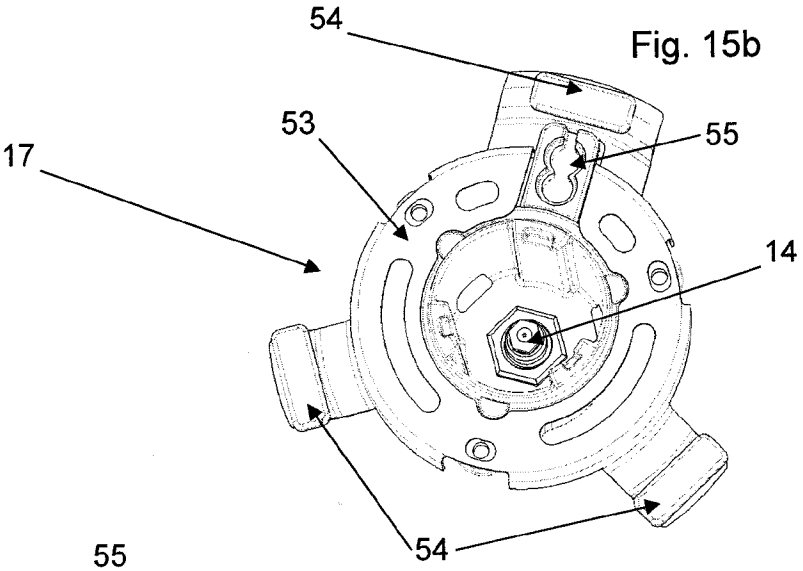
FIG. 15*b* shows an upper view of the cup of the burner of the present invention.
Figure 15A:
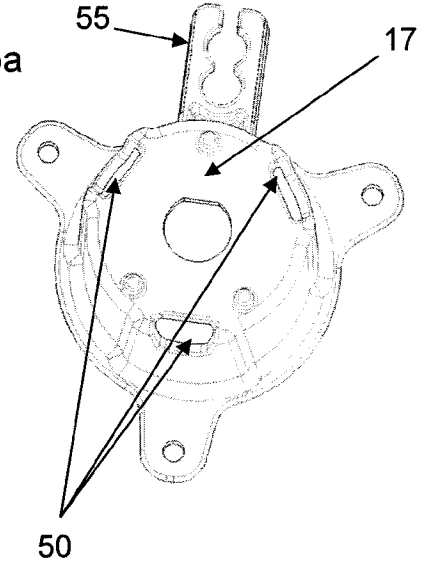
FIG. 15*a* shows a conventional perspective lower view of the cup of the burner of the present invention.
Figure 15C:
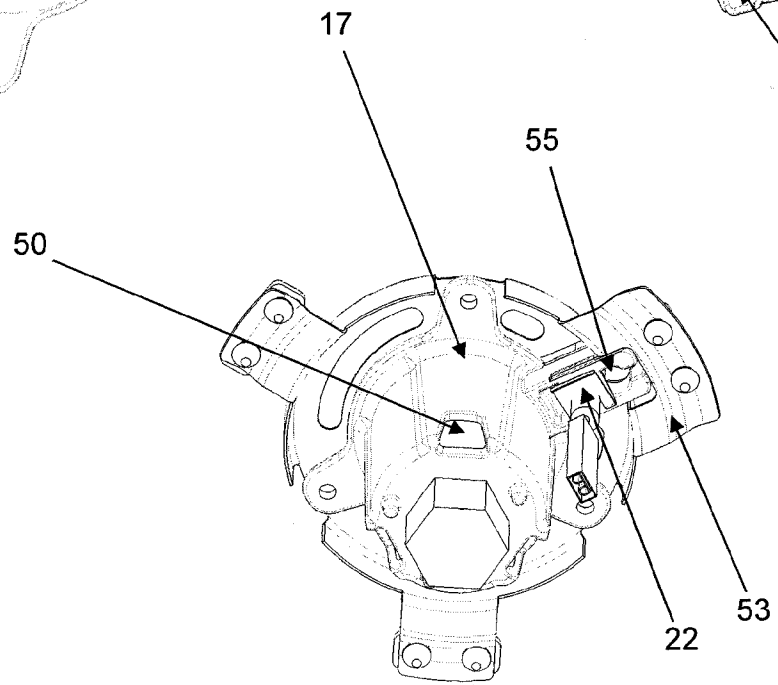
FIG. 15*c* shows a second conventional perspective lower view of the cup of the burner of the present invention.
Figure 15D:
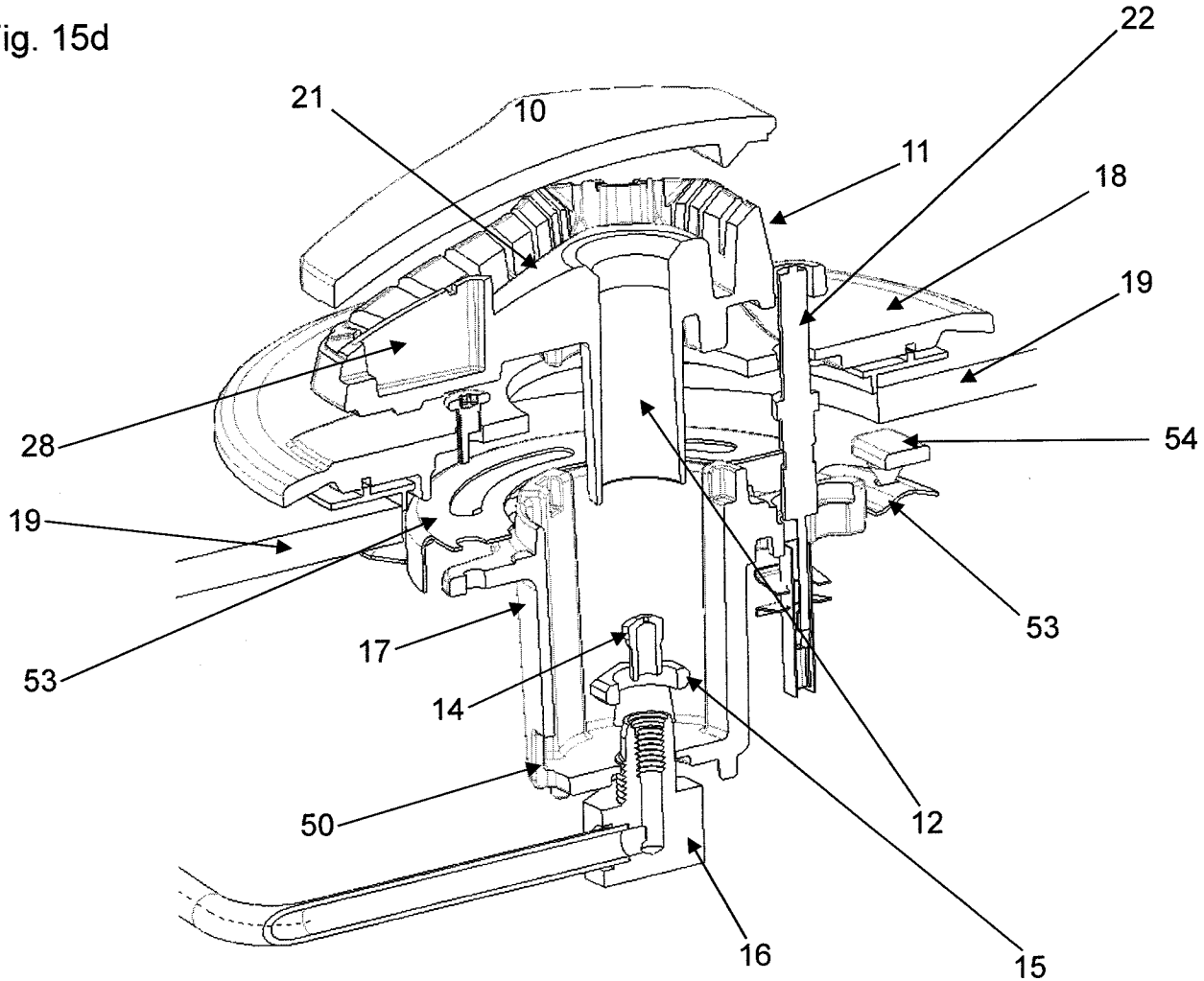
FIG. 15*d* shows a cross section view of the cup of the main embodiment of the present invention.
Figure 16:
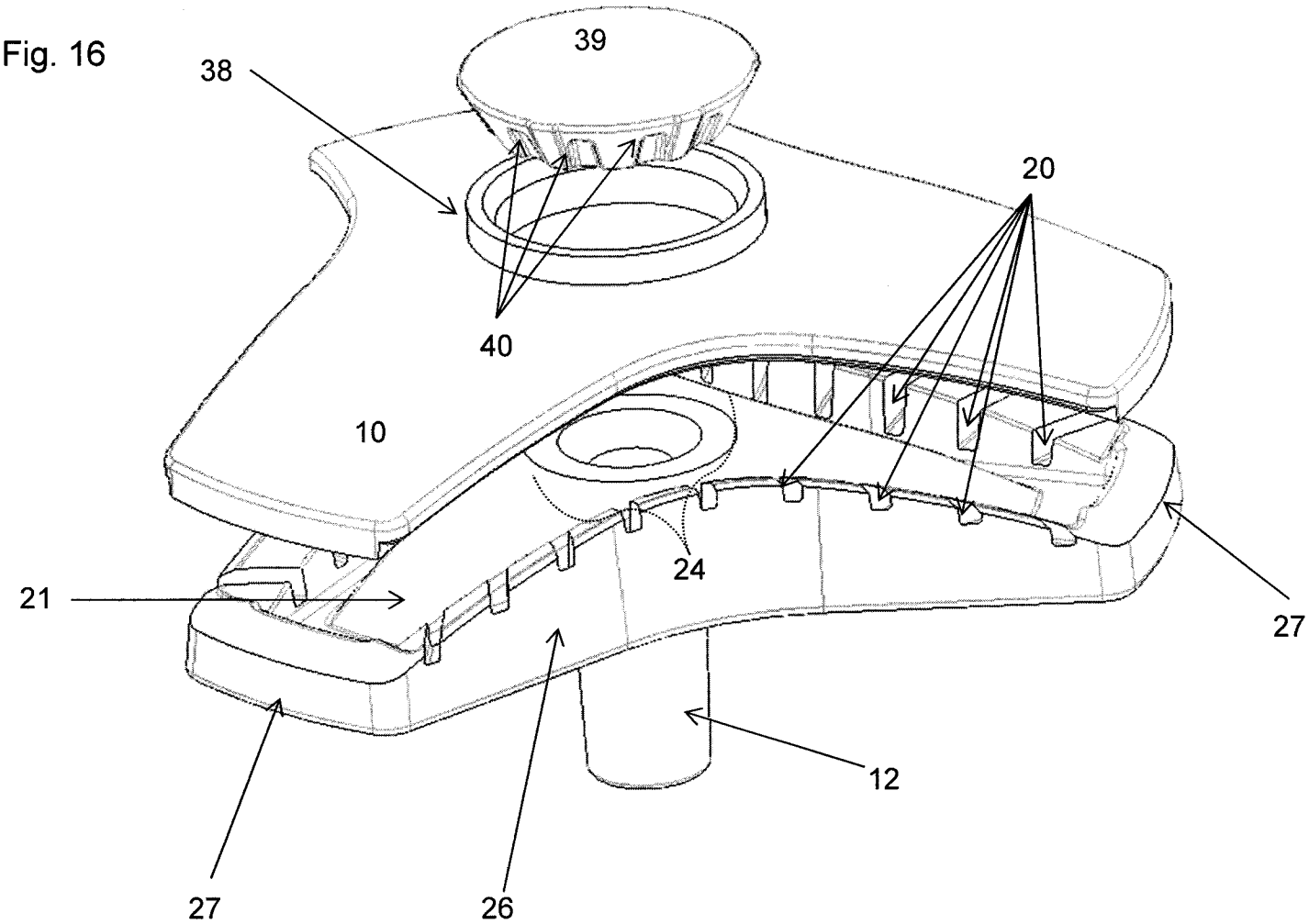
FIG. 16 shows an embodiment of the burner of the present invention, with a central burner.

Another alternative embodiment of the cup 17 is shown in FIGS. 15*b*, 15*c* and 15*d* where there is a cup 17 which is crowned with a lower plate 53 which helps to achieve a greater contact area with the cover's lower face 19, this is particularly useful when said cover 19 is made of fragile materials such as glass or ceramics so that having a larger contact area to support the burner 25 is quite useful as the forces on the grasping area are reduced greatly. In the same way, said lower plate 53 in an alternative embodiment may have a plurality of resilient extremities (the number of these will depend on the specific size and design) said resilient extremities on their border farthest from the cup 17 have some rubbers 54, which may be made of a soft material, such as vinyl or rubber, among others, these are fastened to the extremities by means of a glue or by any means of non-retractable insertion mechanism ("snaps") upon confining the cover 19 between the plate 18 and the lower plate 53. Said rubbers 54 make contact with the cover's 19 lower face thus flexing the resilient extremities which contain them by adjusting the fastening means which join the plate 18 to the cup 17, grasping in this way the cover 19 in a crimping manner (see FIG. 15*d*).

With such luck that any of the configurations which the cup 17 may have, the combustible-air mixture is dragged by the Venturi effect within the Venturi tube 17, said mixture collides with the lid 10 where energy and velocity are lost. In the mixture chamber 23 which contains more or less the volume of a cylinder with a diameter slightly greater than the diameter of the Venturi tube 17, the diameter of said chamber mixture 23 is dimensioned with utmost preciseness, because if it is too small this would not allow for proper mixture of the combustible air, and if it is too large, velocity of the mixture is lost producing small darts of flame, lacking shape, force and highly inefficient. Thus, upon pursuing its path through the burner's interior the mixture finds the platform 21, which is charged with the function of ordering the mixture flow so that it arrives to the ports with enough velocity, even the more distant ones on the discharge zone 24 of the Venturi tube 17.

Figure 5:
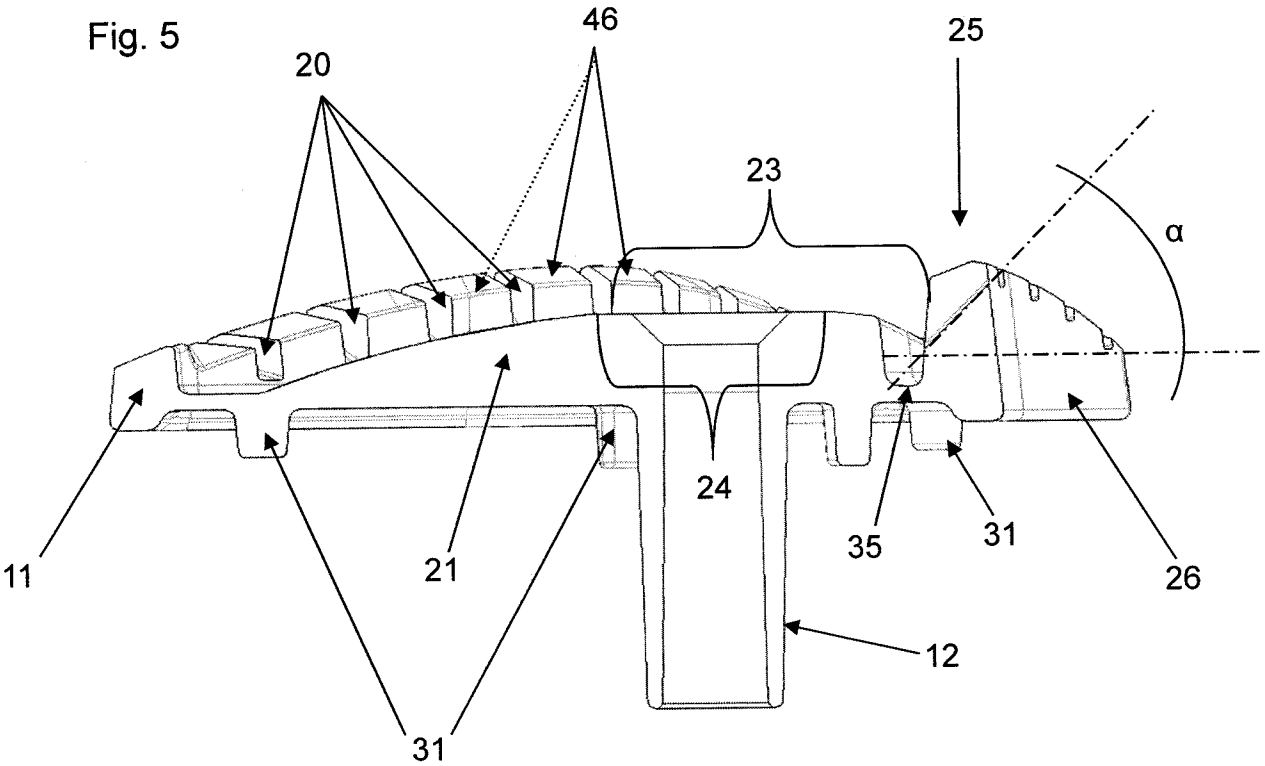
FIG. 5 is a cross cut view of the burner of the present invention.

The flame darts are produced in the ports, which have a particular geometry; FIGS. 5 and 6 show a cross cut of a burner 25, whereas FIG. 5 does not show a lid 10, FIG. 5 does show a lid. In FIG. 5 the Venturi tube 12 can be seen through which the mixture travels towards its upper part, where upon reaching the discharge zone 24 this expands to lose velocity. Said discharge zone 24 is found on the high part of the platform 21. The platform in this zone in an alternative embodiment may be generally plane and later follow a curvature of the curved surface which defines it. AS can be appreciated in FIGS. 2 and 3 the discharge zone 24 is delimited by a circumference tangential to the horizontal curvature of the platform, which is substantially parallel to the horizontal curvature of the crenellated wall 26 creating a channel 35 which is formed between the inner face of said crenellated wall 26 and the inner lateral face of the platform 21 (see FIGS. 5 and 6). Said channel 35 helps in the transport and distribution of the mixture in a homogenous way along the length of the crenellated wall 26, in addition to regulating its velocity ensuring that there is sufficient mixture with the necessary energy to be able to cross the ports 20 to later ignite or turn on and form the flame darts.

As can be observed in FIGS. 5 and 6, the ports follow the angle α formed between its base and the horizontal, this angle α gives the port an upward inclination, which allows it to direct the flame dart towards the outside and towards above, achieving through this a dart which attempts to cover a higher contact area with the utensil to be heated, as well as an efficient combustion dart. To help in the formation of the dart granting it better appearance and stability, the lid 10 is given a bevel 33 and extremity 34 on the lower part of its edge or border, which (bevel 33 and extremity 34) run in parallel form to the rib 32.

As can be seen in FIGS. 9*a*, 9*b*, 10, 11*a* and 11*b* the vertexes 27 are set with at least one secondary port 36 or 37 which allows for the transport of the flame between the ports 20 form a first crenellated wall 26 and the ports of a second crenellated wall 26, where the crenellated walls are in contact with the same vertex 27. In this way on the vertexes 27 can be set a series of ports, said secondary ports 36 or 37 in addition to functioning as transport ports also increase the burner's 25 thermal potential.

In a preferred embodiment of the body of the burner 11, the peculiar design of the secondary ports' 36 of the vertexes 27 follows that at the end of the platform 21 in the part farthest from the mixture chamber 23 of the burner 25, precisely at the vertexes 27, the mixture's velocity is very low thus said mixture fluid has low energy to be able to cross a port with the main port 20 design, so that the cross cut section, as well as the port area, of said secondary ports 36 is smaller in comparison to the main ports 20, which helps accelerate the mixture fluid through the channel or duct of the secondary port 36 creating a small dart only outwardly directed, since the secondary ports 36 are not set with an angle or divergent as are the main ports 20, however, the base angle of the secondary ports 36 oscillates between approximately 0° and 10°.

Figure 10:
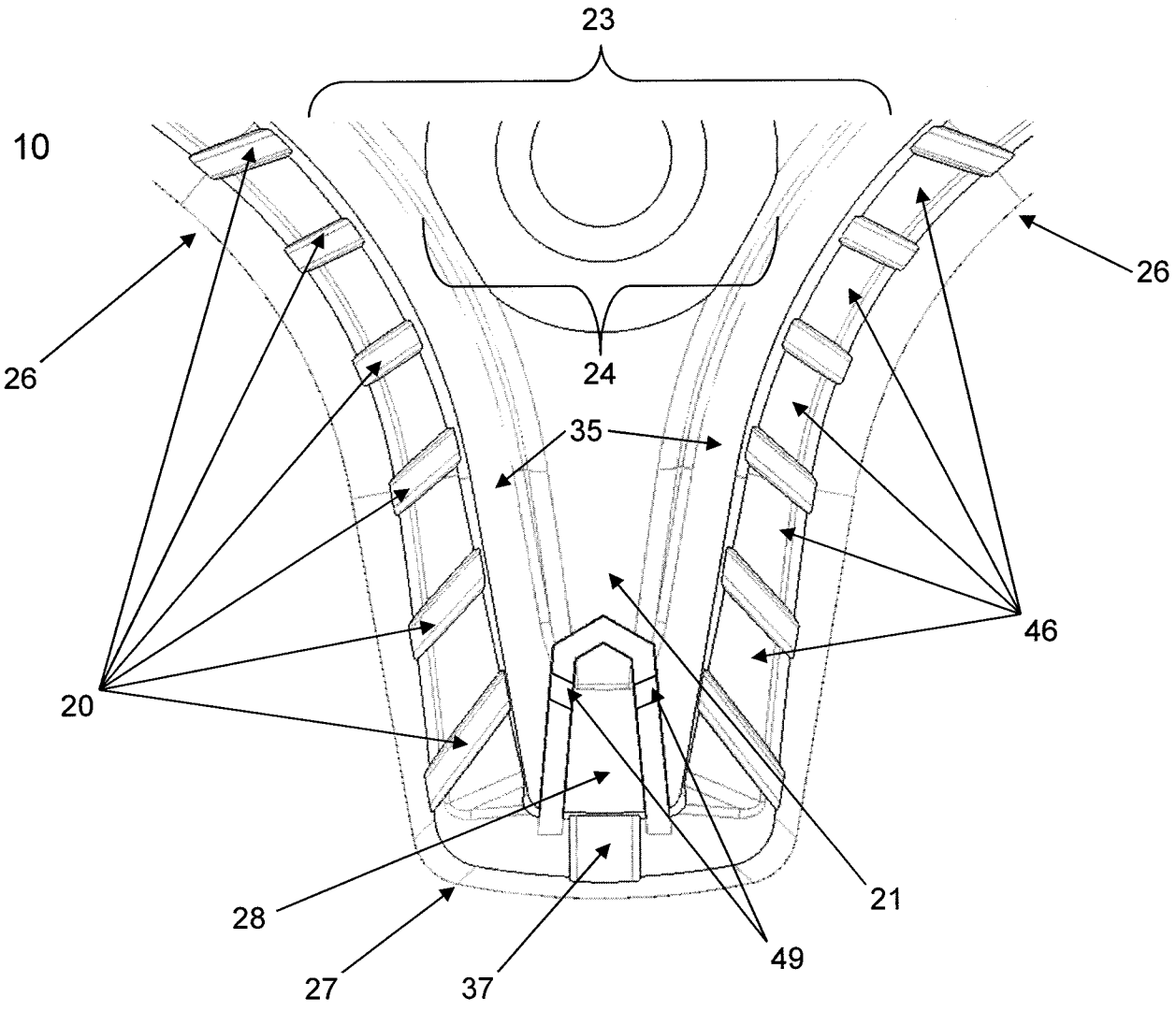
FIG. 10 is an upper view of one of the ends of the burner of the present invention, in a first embodiment.
Figures 11A, 11B:
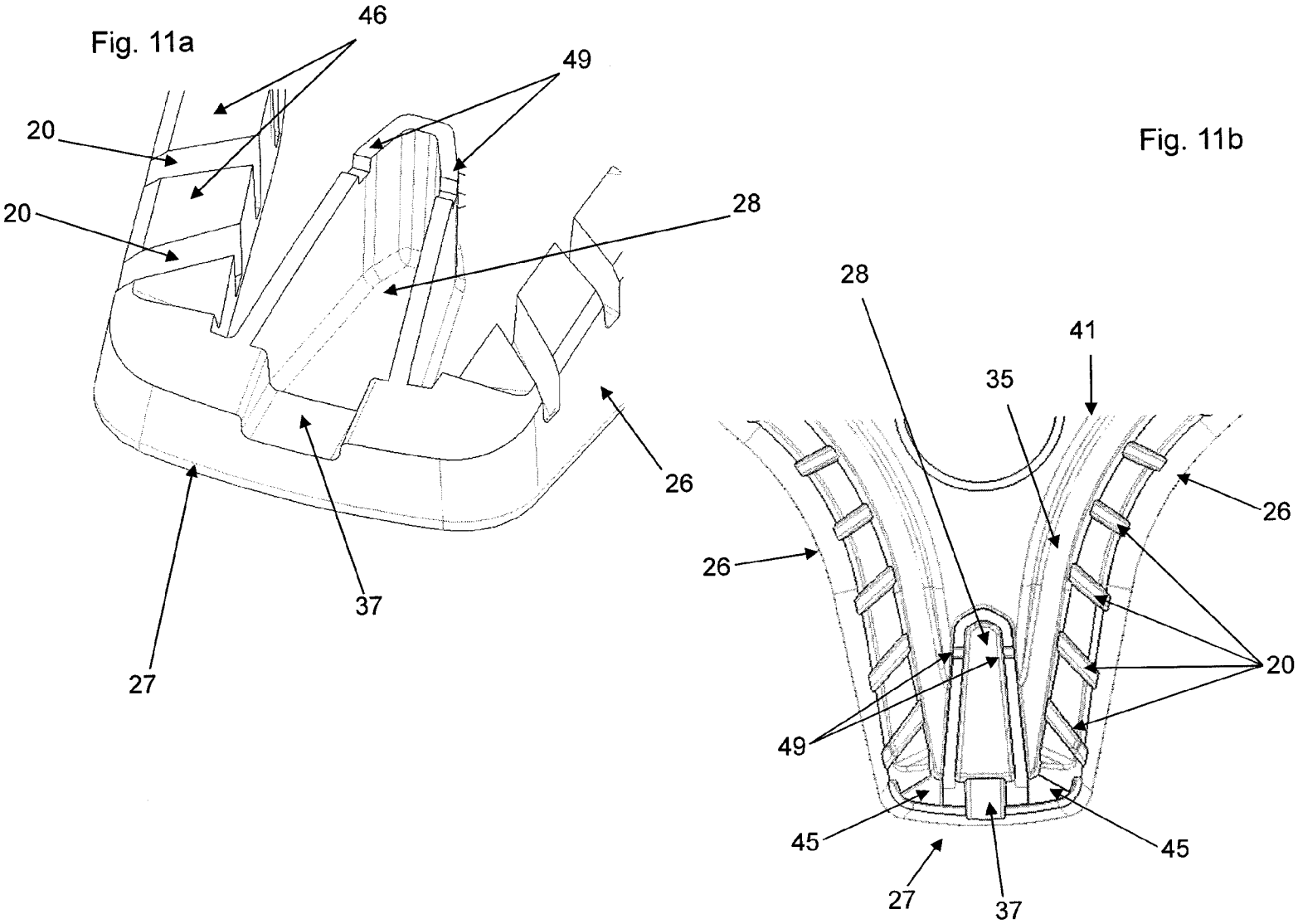
FIG. 11*a* is a conventional perspective view of an end of the burner of the present invention, where said figure shows a sub-embodiment of the first embodiment.
FIG. 11*b* is an upper view of the sub-embodiment of the first embodiment of FIG. 11*a*.

In an alternative embodiment of the body of the burner 11 the secondary ports 37 service a stability chamber 28 found between the extreme part of the platform 21 and the vertex 27 (see FIGS. 10, 11*a* and 11*b*). Said ports 37 are formed from a groove over the vertex 27, of a given width and depth which create a port area which is approximately from 5 $mm^2$ to 30 $mm^2$, which are calculated according to the burner 25 size, the combustible to be used and the stability chamber 28 size, among other design considerations. In this manner, the port is delimited in its upper part by the lid 10, and in this way, the port's duct 37 is formed. The stability chamber is found precisely at the area farthest from the discharge area 24 where the mixture no longer has sufficient kinetic energy, the fluid velocity of the mixture being very low. In this manner, in the vertex area 27 a stability chamber 28 is formed in a shape similar to a pentagon somewhat irregular or an elongated horseshoe, and which is set at some point over its periphery with at least one transference groove 49, which allows the passage of a determined quantity of (fluid) mixture towards the inner part of the stability chamber 28. The objective of said stability chamber 28 is to guard a small flame within the burner 25, so that in case there is a lot of wind or the air velocity surrounding the burner 25 is high, to such a degree that it may turn off one or some of the dart flames of the ports 20, a flame guarded within the stability chamber 28 may be guarded from said air currents, and said guarded flame in the stability chamber 28 may be able to reignite or turn on the remainder of the ports 20 and thus recovering the lost flame darts. The stability chamber 28 safeguards the mixture with low or null velocity which allows for always being able to burn mixture without it being dispersed into the inner part of the burner 25.

Preferred Embodiment with Central Burner 39

Figure 17C:
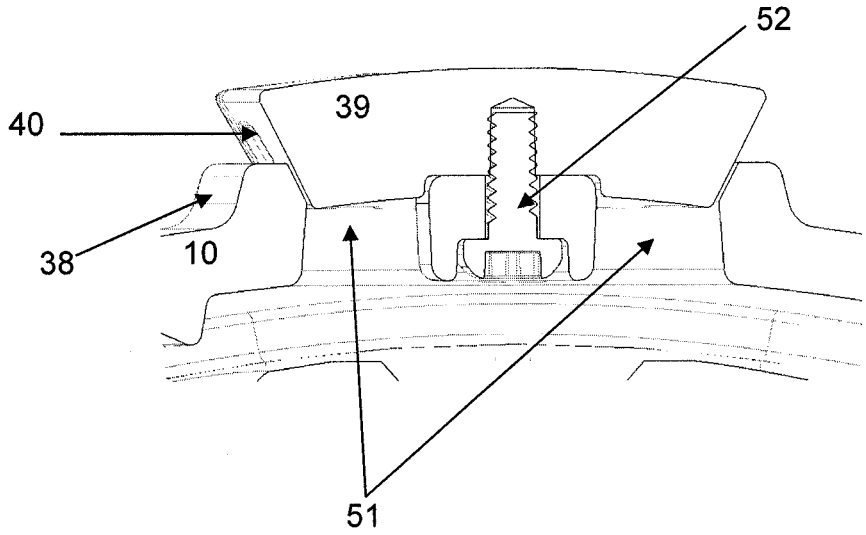
FIG. 17*c* shows a cross section view of the central burner in conjunction with part of the burner of the present invention according to the embodiment of FIG. 16.
Figure 17A:
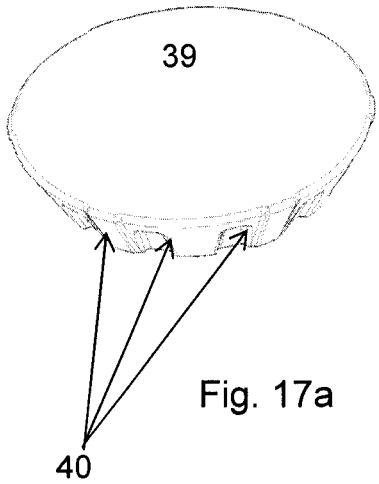
FIG. 17*a* shows a conventional perspective view of the central burner in the embodiment of FIG. 16.
Figure 17B:
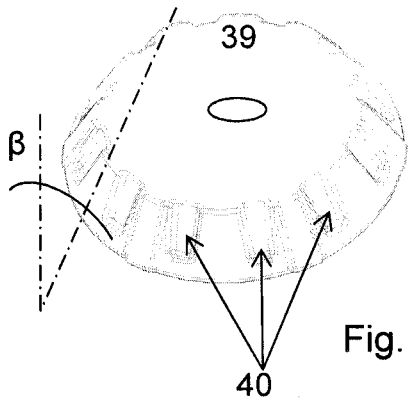
FIG. 17*b* shows a conventional perspective lower view of the central burner in the embodiment of FIG. 16.

FIGS. 17*a* and 17*b* show the central body of the burner 39 in isometric. Said central burner body 39 is preferably a single-piece solid truncated cone, which is preferably manufactured from some metal or alloy which is able to withstand high temperatures as well as manufacture ease. It can be seen that on its periphery face it has 40 ports set in low relief, which follow an angle β from the described cone between the perimeter on its lower and upper face. The height combined with the angle β of the central body of the burner 39 allows for the creation of darts which are substantially directed towards above and outside, with sufficient length so that the heat produced by them may ignite the darts produced by the ports 20 found in the crenellated wall 26 of the body of the burner 11 near said central burner 39, without allowing the darts produced by said ports 40 to touch, collide or collapse unto or with the darts produced by said ports 20.

Figure 18:
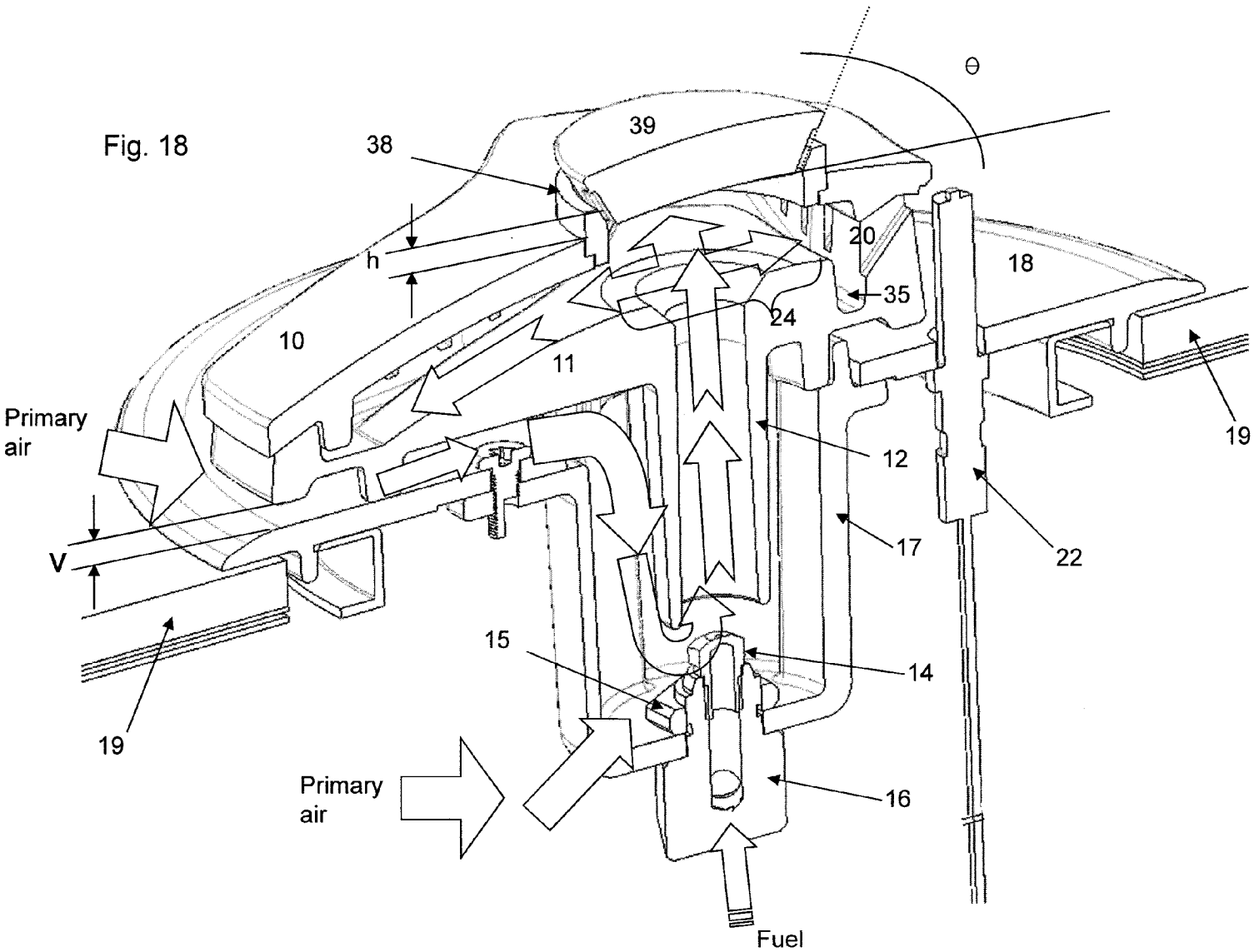
FIG. 18 shows a perspective and a cross section view of the burner according to the embodiment of FIG. 16 which shows the fluid flow in the burner.

FIGS. 17*c* and 18 show that the lid 10 is set with a cavity precisely in its center, where a separator ring 38 is placed which supports the central burner 39. Said separator ring, in addition to supporting the body of the burner 39 also helps to separate the upper face of the lid 10 of the central burner 39, since if this latter one were to be set without said ring 38, the mixture which exits through the central cavity through the ports 40 of the central burner 39, would have to follow its flow over the lid's 10 upper face's surface ("capacity limit" effect) so that it is necessary to separate the central burner from the lids' 10 upper face. Thus with the ring 38, we achieve separating in addition to supporting the central burner 39 creating a type of step. Upon passing through the Venturi tube 12 the mixture reaches a discharge zone 24 to expand within the mixture chamber 23. Since the cavity where the central burner 39 is placed is found precisely above the discussed discharge zone 24, the mixture contains enough kinetic energy to exit through the ports 40 of the central burner 39, and given their placement, the dart flames can be directed towards the outside or towards above, which allows for the ignition or turning on of the ports 20 near the central burner 39, in addition to having better contact with the utensil to be heated.

FIG. 17*c* shows a preferred embodiment to the embodiment discussed in the above paragraph, where said cavity at the center of the lid 10 may contain a beam 51 which crosses diametrically, this with the purpose of being able to place a fastening means 52 such as could be a screw, rivet or similar which may grasp and center the central burner 39 in the cavity with the lid 10, this way guaranteeing that said central burner 39 is always in the correct position, since if this were not to be the case, it could largely impact the formation of the flame darts. The lower face of the central burner 39 may, in a preferred embodiment have a diametrical groove which houses the upper part or back spine of the beam (see FIG. 17*e*).

Figure 17E:
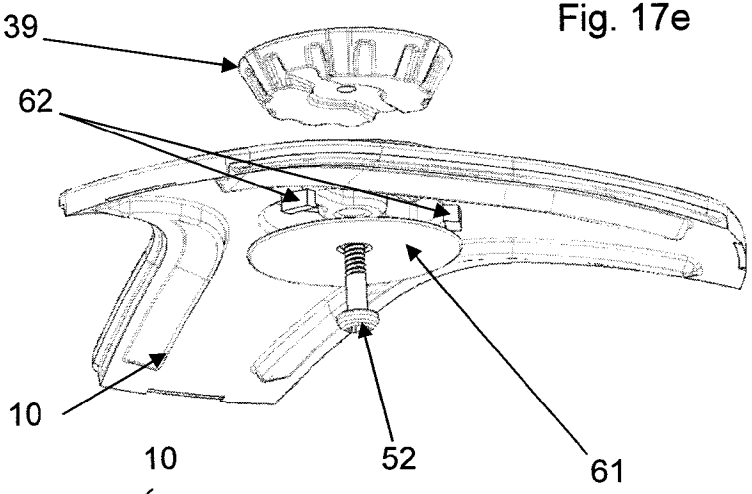
FIG. 17*e* shows a perspective lower view of the lid and the central burner according to the embodiment of FIG. 16, where the elements are shown in explosion.
Figure 17D:
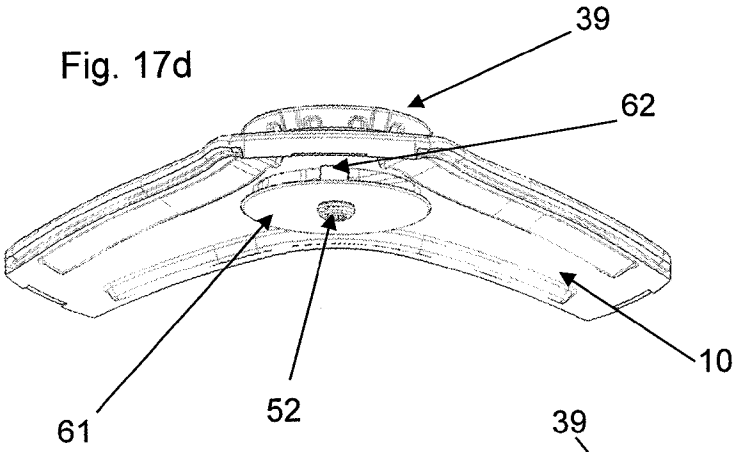
FIG. 17*d* shows a perspective lower view of the lid and the central burner according to the embodiment of FIG. 16.
Figure 17F:
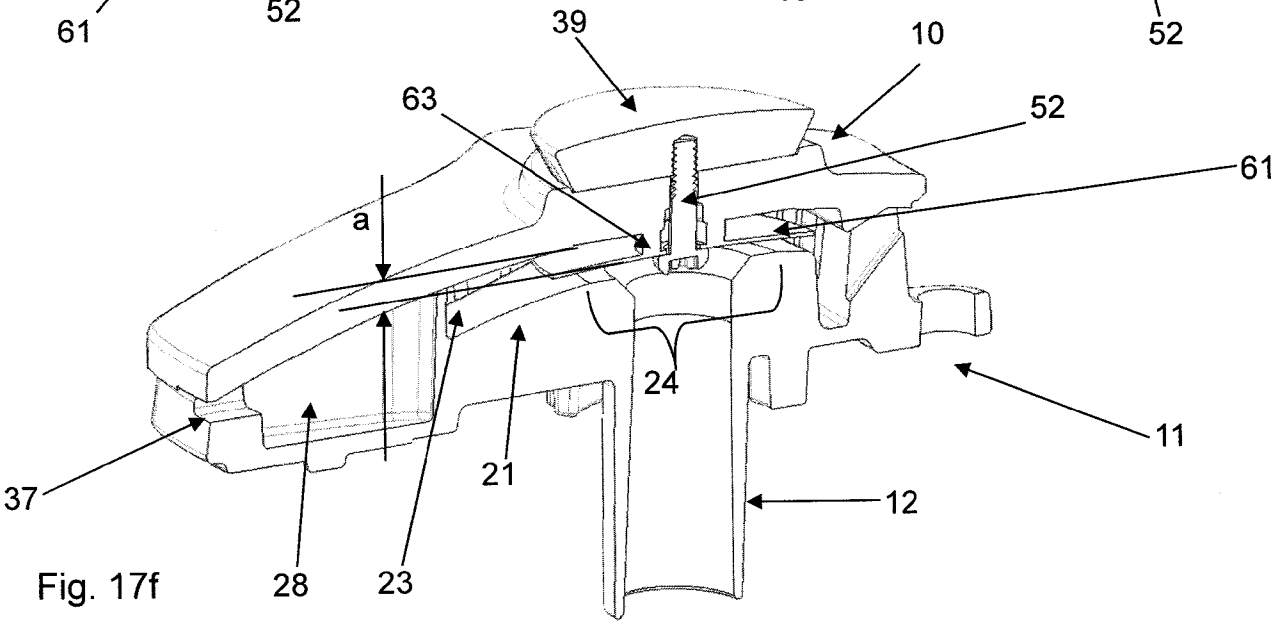
FIG. 17*f* shows a cross-section view of the burner embodiment of FIG. 16.

Furthermore, a second preferred embodiment to the one described in the preceding paragraph may be seen in FIGS. 17*d*, 17*e* and 17*f*, where the lid 10 is set with a slice section 61 which covers the central cavity which houses the central burner 39, which has the function of regulating the mass flow of the mixture towards the ports 40 of the central burner 39, knowing that as was previously explained, the mixture to pass through the Venturi tube 12 reaches the discharge zone 24 to later expand within the mixture chamber 23. Since the cavity where the central burner 39 is placed is found precisely above the discussed discharge zone 24, the mixture contains enough kinetic energy to exit through the ports 40 of the central burner 39, where the case could be that the mixture's kinetic energy be so high that it create dart flames which are too long or even flame detachment, and thus the use of a slice section 61 was conceived, knowing that, the mixture upon not being able to follow its natural flow given that the slice section 61 interferes with it, the flow of mixture is forced to circumvent said slice section 61, thus decelerating the flow of the mixture. Additionally, separation "a" between the slice section 61 and the edge or periphery of the central cavity on the lid 20 also aids in regulating the flow of mixture towards the ports 40 of the central burner 39. Thus, said slice section 61 which may be made from a sheet of steel or any metal or any alloy which can withstand high temperatures, has to be narrow enough with a constant cross section to not be in the way of the platform 21 or the flow mixture. Said slice section 61 may have a geometry similar to a disc or polygon and in an alternative embodiment its horizontal faces may follow a curved surface which describes the lid 10 or the platform 21.

Now, the slice section 61 and the edge or periphery of the central cavity on the lid 20 have a vertical distance "a" varying approximately between 0.5 mm and 5 mm and this may be regulated in one of two ways, the first uses at least one block 62 set on the lid's 10 lower face, whereas the second uses a neck 63 protruding over the beam's 51 center, precisely surrounding the hole through which the fastening means 52 passes, where the height "a" is similar to the height of the protrusion in the neck 63. In this way, by having a height "a" between the periphery of the lid's 10 central cavity and the slice section 61, the mass flow of mixture is regulated towards the ports 40 of the burner 39, so that the mixture arrives with the sufficient kinetic energy to generate uniform flame darts with ideal characteristics, completely correcting the separation of flame problem which could be generated in the ports 40 of the central burner 39.

Tandem Burner Embodiment

Figures 19A, 19B:
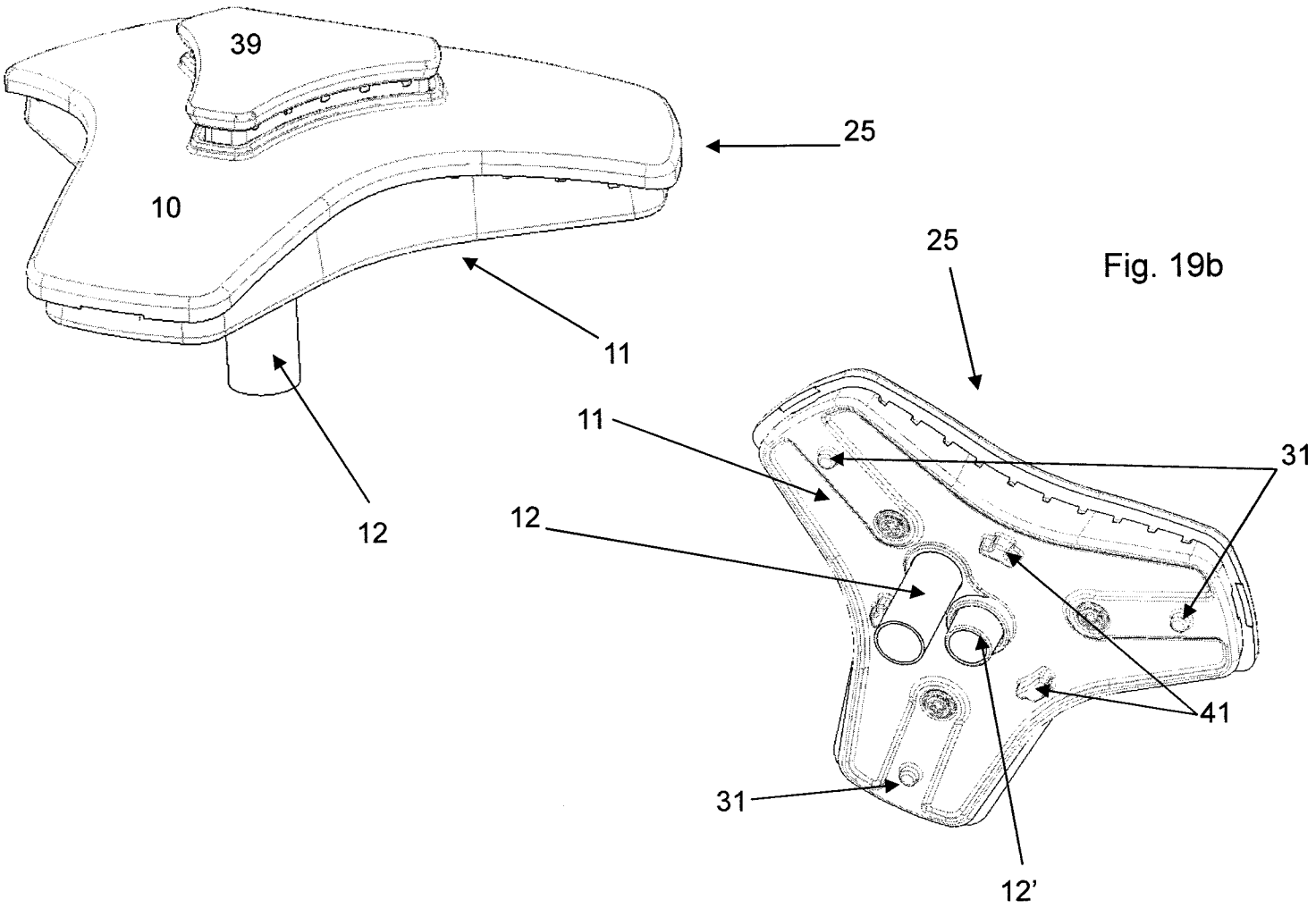
FIG. 19*a* shows yet another embodiment of the burner of the present invention, with a different central burner.
FIG. 19*b* shows a lower perspective view of the embodiment in FIG. 19*a*.

Another preferred embodiment of the present invention is shown in FIGS. 19*a*, 19*b*, 20, 21, 22*a*, 22*b*, 22*c*, 23*a*, 23*b*, 23*c*, 24*a*, 24*b*, 24*c*, 25 and 26 where a system of burners which comprises a body of the burner 25 and on its upper part a central burner 39, which has a Venturi tube 12' which is independent from the body of the burner 11; said embodiment is discussed as follows:

FIGS. 19*a* and 19*b* allow us to glimpse the embodiment of burner 25 being discussed, where in FIG. 19*a* we can see that the central burner 39 follows the geometric shape of the lid's 10 periphery. Different from the previous embodiments, the central burner 39 comprises a burner body 11' made of crenellated walls 26' with its own Venturi tube 12''' with such luck that a burner is over another (tandem or stacked) which both function independently.

Figure 20:
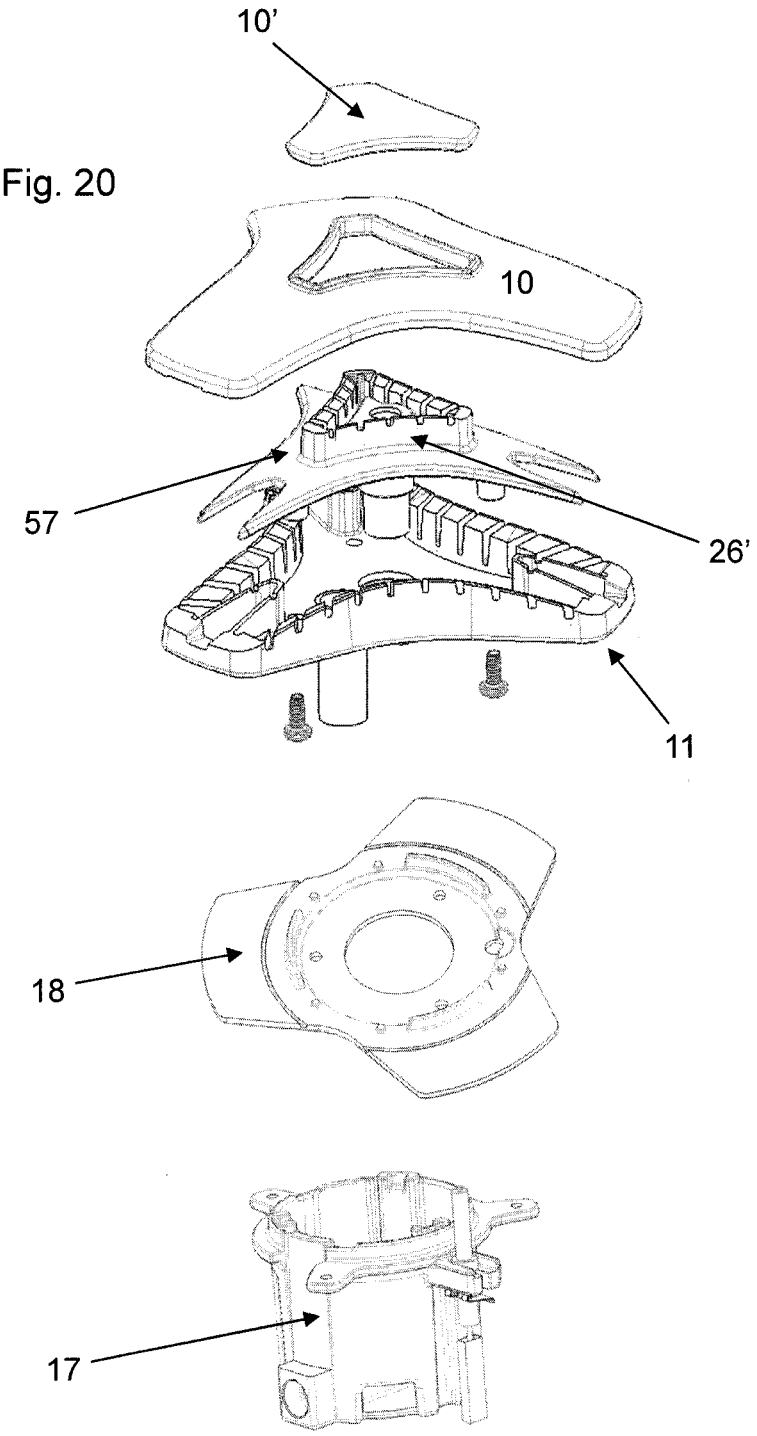
FIG. 20 shows an exploded view of the embodiment in FIG. 19*a*.

FIG. 20 shows an exploded view of the burner 25 of the embodiment being discussed, where a mask 57 is placed over the body of the burner 11, which has some openings or bays 58 on its vertexes which have substantially the same geometry than those of the stability chamber 28 on the vertexes 27, knowing that said mask 57 seals the inner chamber from the body of the burner 11 so that the mixture of the body of the burner 11 not be stirred with the mixture of the central burner 39. The lid 10 is placed over said mask also covering the ports 20 of the crenellated wall 26; the lid itself 10' covers the ports of the crenellated wall 26'. The lower face of the body of the burner 11 rests on the cover 19: in a preferred embodiment, between the lower face of the body of the burner 11 and the cover 19 a diffuser plate 18 is set; on the lower face of the cover 19 a cup 17 is placed which may or may not have a lower plate 53; it should be noted that the lid 10 is set with a separator ring 38' (see FIG. 23*a*), where said separator ring 38' does not have the same function as that of the ring 38 shown in FIG. 18, as the separator ring 38' does not support the central body of the burner 39 nor cooperate with it to form the port duct 40, or the angle θ; since as was described in the preceding lines the central burner 39 in tandem is supported or forms a monolithic part of the mask 57, and given this it does not rest on said separator ring 38', even so, said separator ring 38' maintains one of the functions of the separator ring 38, which is to help avoid the previously described "capacity limit" effect.

Figures 21A, 21B:
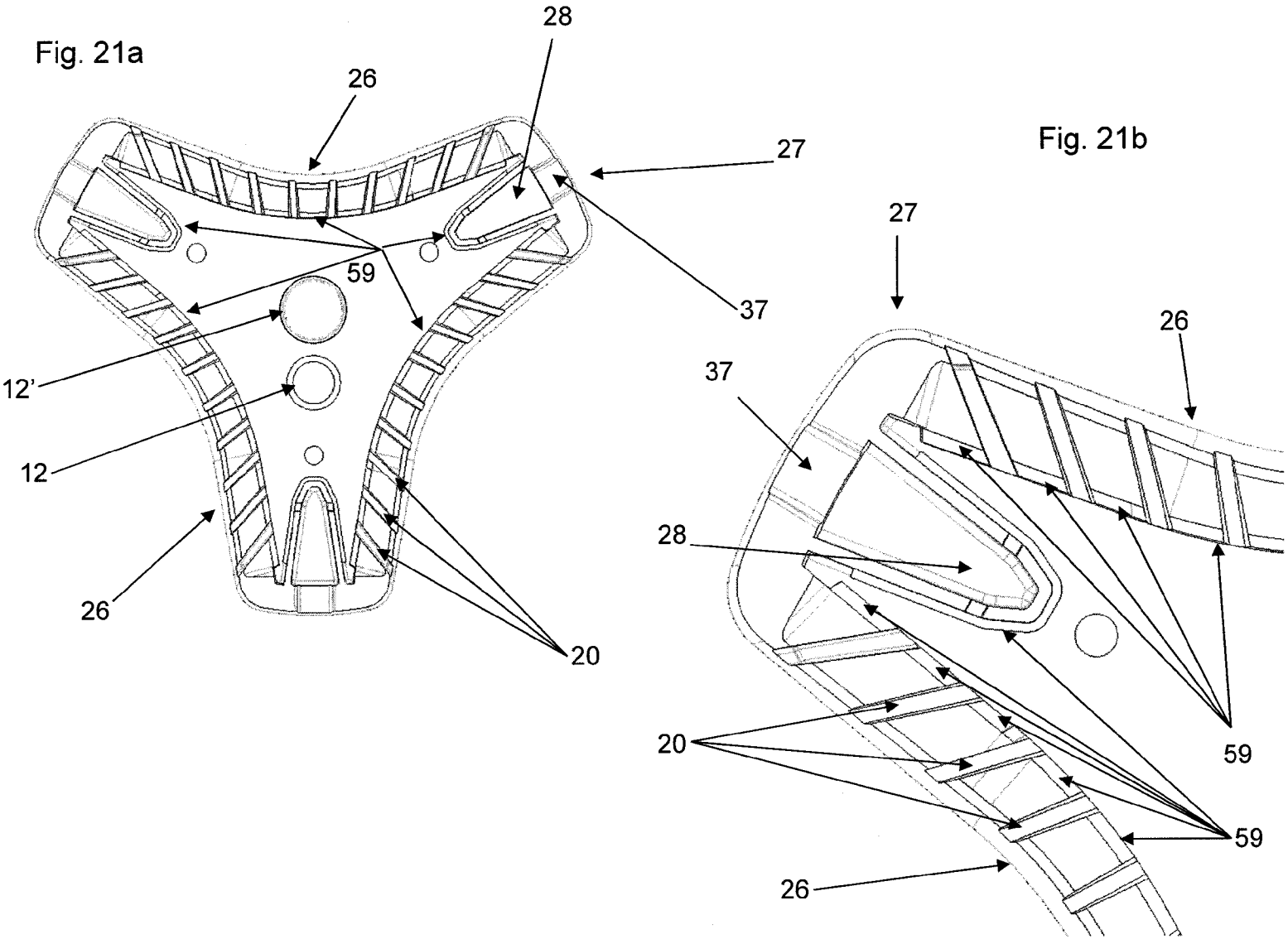
FIG. 21*a* shows an upper view of yet another embodiment of the present invention, specifically where this embodiment is set to be used in conjunction with FIG. 19*a*.
FIG. 21*b* is an upper view of a detail of the embodiment in FIG. 21*a*.
Figure 21C:
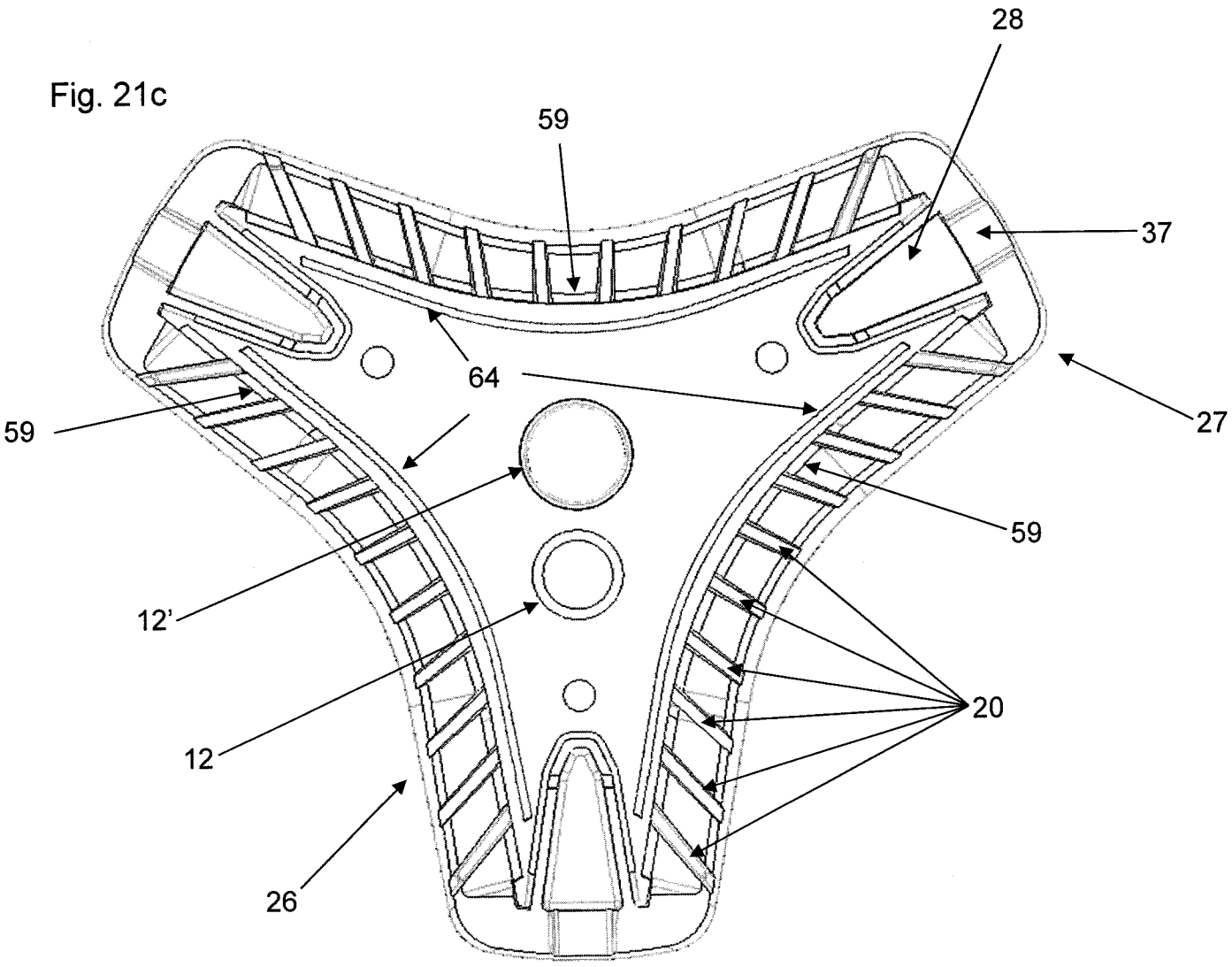
FIG. 21*c* is an upper view of the embodiment of claim 21a, including barrier rails.

FIG. 21*a* shows the body of the burner 11 of the embodiment being described; conceptually, as well as geometrically, its equal to the one described above in the section labeled "Body of the burner 11" knowing that it is also formed by the same crenellated walls 26, the ports 20, as well as the port ducts 20 being equal to or sharing the same design criteria, geometry and conceptual features, with the exception that this embodiment could not have a platform 21 and that the Venturi tube 12 which feeds it is not placed in the geometric center of this; it should also be highlighted that the vertical inner face of the crenellated wall 26*h* as a back spine 59 which it supports and is coupled to the mask 57, because as was mentioned in the lines above, the mask 57 seals the chamber of the body of the burner 11, however the ports 20, the duct ports as well as the upper part of the crenellated walls 26 are covered by the lid 10 such as was described in the previous embodiments; an alternative embodiment to the one presently being described, is shown in FIG. 21*c*, where vertical walls or barrier rails 64 which are parallel to the back spine 59 or vertical inner wall of the crenellated wall 26, said barrier rails have a height such that they do not reach the lid's 10 lower face, so that a gap exists or a distance between the upper face of said barrier wall and the lid's 10 lower face preferably varying between 0.5 mm to 5 mm; now then, the mixture upon not being able to follow its natural flow given that the barrier rail 64 interferes with it, the mixture flow is forced to surround said barrier rail 64, thus decelerating the mixture flow, in addition to the separation or gap between the barrier rail's 64 upper face and the lid's 10 lower face also aids in regulating the mixture flow towards the ports 20; said barrier rail can be partly molded or machined to the body of the burner 11 or in some way mechanically inserted into this.

Mask 57

The mask 57 works in a similar manner to the lid 10, knowing that part of the geometry of a curved surface over the horizontal plane, where said curved surface could possibly be a dome, sphere or parabolic among others. Thus this curved surface is cut by another curved surface over the horizontal plane which is a curve very similar to the one being used to form the crenellated wall 26, so that following its contours is important. In this same vein, the mask 57 follows the contour of the body of the burner 11 periphery, so that its geometry will define the mask's 57 contour. It should also be highlighted that the mask, at its vertexes and ends comprises a recess or bay 58 of the same contour shape as that of the stability chamber 28 at the vertexes 27 of the body of the burner 11, this is because the stability chamber 28 is covered by the lid 10.

Figure 22B:
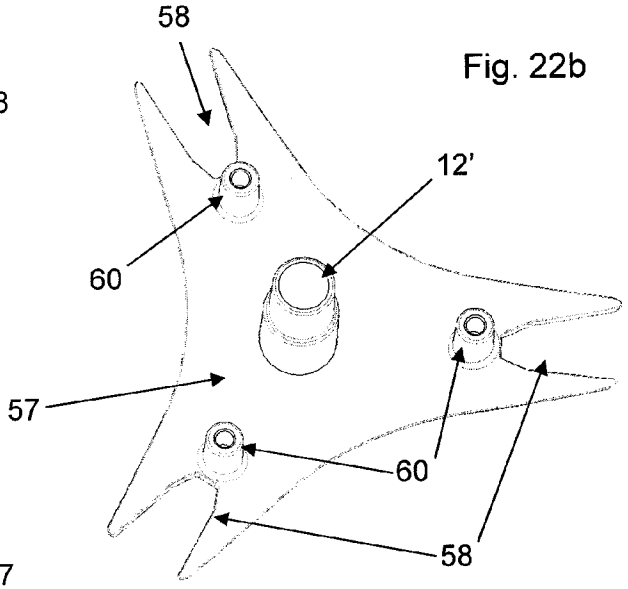
FIG. 22*b* is a lower view of the central burner of the embodiment in FIG. 19*a*.
Figure 22A:
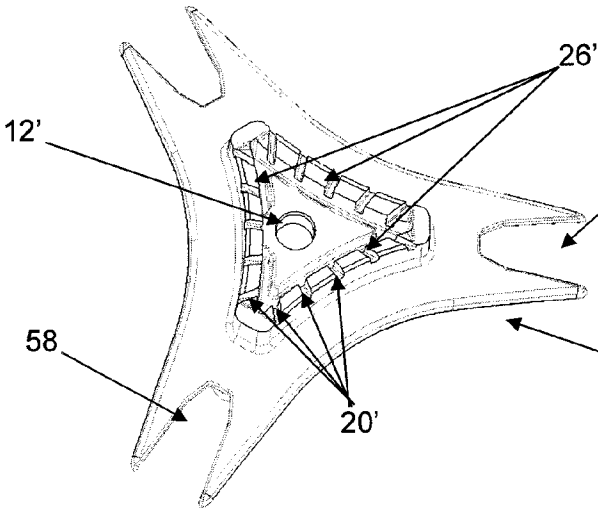
FIG. 22*a* is an upper view of the central burner of the embodiment in FIG. 19*a*.
Figure 22C:
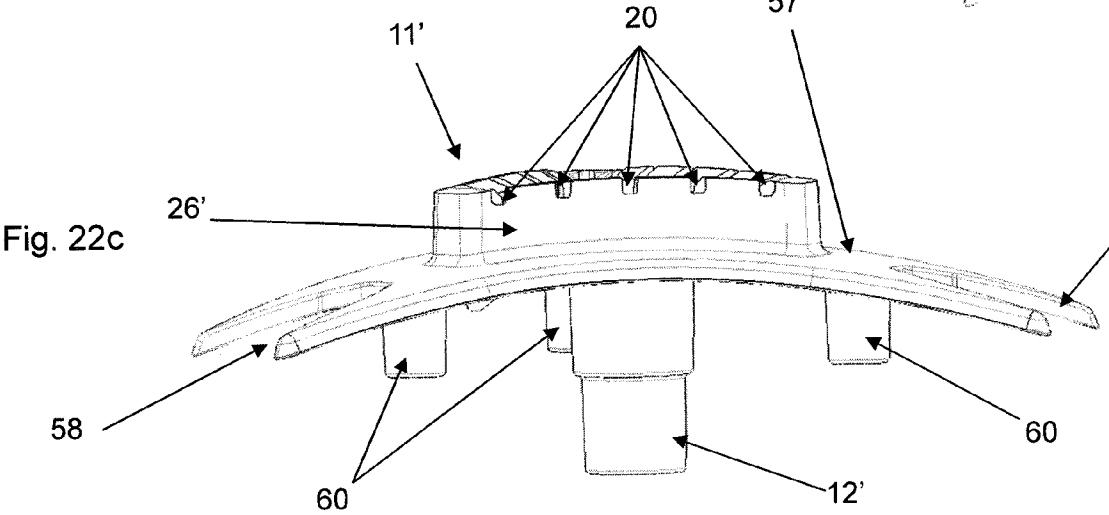
FIG. 22*c* is a front view of the central burner of the embodiment in FIG. 19*a*.
Figure 23B:
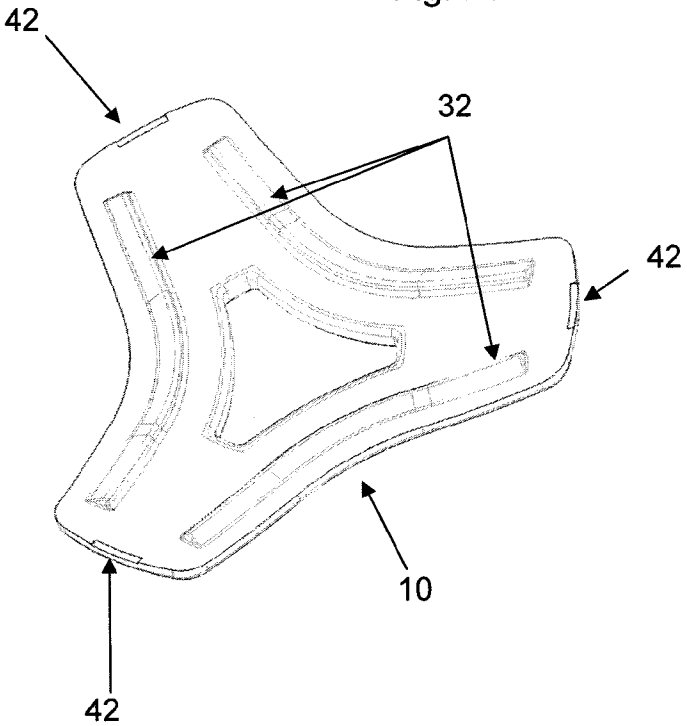
FIG. 23*b* is a conventional perspective lower view of the lid of the main burner of the embodiment in FIG. 19*a*.
Figure 23A:
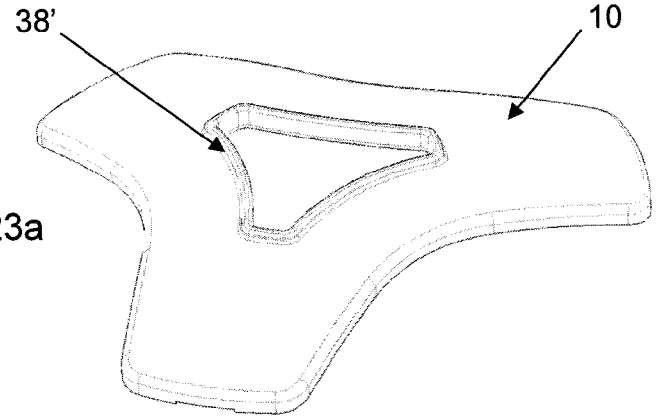
FIG. 23*a* is a conventional perspective view of the lid of the main burner of the embodiment in FIG. 19*a*.
Figure 23C:
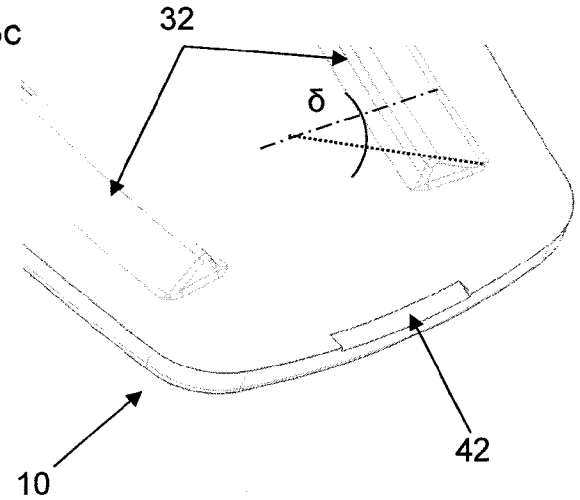
FIG. 23*c* is an upper view of a detail of the lid of the main burner of the embodiment in FIG. 19*a*.

From FIGS. 22*b* and 22*c* posts 60 on the burner's lower part can be noted which render support to the mask 57 on the body of the burner 11 and also help maintain the correct distance between the inner face of the body of the burner 11 chamber and the mask's 57 lower face. The Venturi tube 12' which feeds the mixture to the upper burner 39 can also be noted.

Said central burner 39 is substantially set on the center on the upper face of the mask 57, being formed by crenellated walls 26' which follow the same geometric and design criteria of the crenellated walls 26 of the body of the burner 11. The same applies to the ports 20' of the central burner 39, given that they also follow the same geometry and design criteria as those in the ports 20 of the body of the burner 11, on a smaller scale.

Figure 24B:
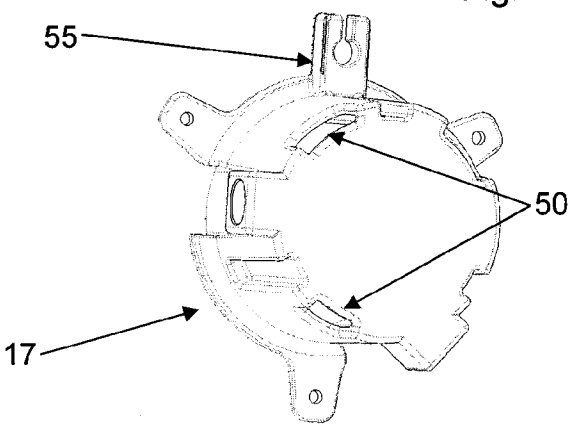
FIG. 24*b* is a lower perspective view of the embodiment in FIG. 24*a*.
Figure 24A:
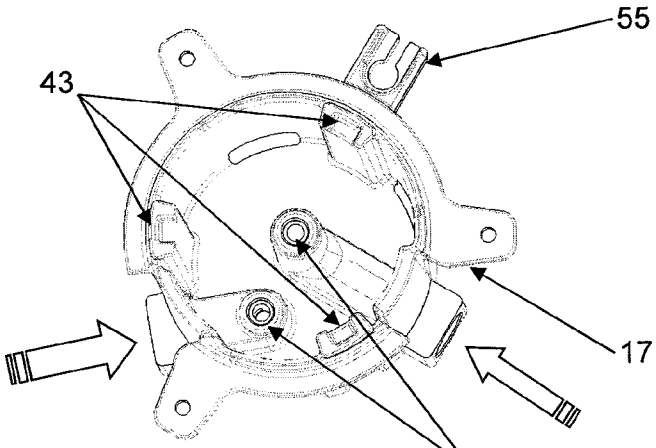
FIG. 24*a* is an upper view of the cup in an embodiment of the present invention.
Figure 24C:
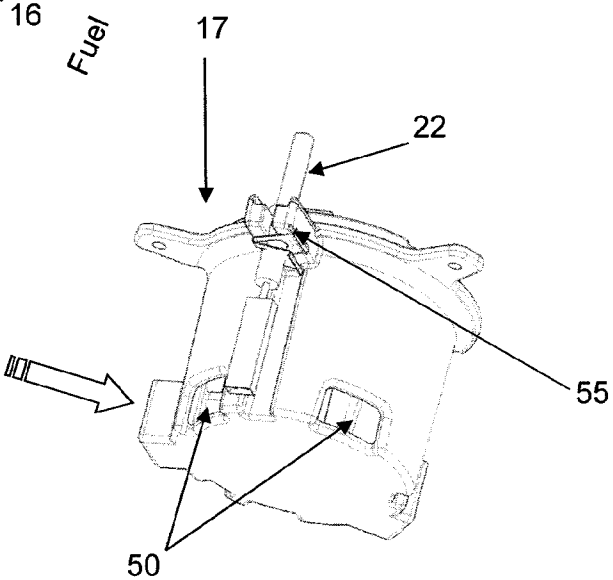
FIG. 24*c* is a conventional perspective lower view of the embodiment in FIG. 24*a*.

FIGS. 24*a*, 24*b* and 24*c* show an alternative embodiment of the cup with the pertinent modifications for the embodiment of the tandem burner presently being discussed. The centering ribs 43, spark plug support 55 and windows 50 among others are the same in concept, geometry and design to those of the cup 17 embodiments previously described, their variants or embodiments being applicable to the present cup 17 embodiment, with the exception that in this case two entries for the combustible are required instead of one, thus it comprises two mini-connectors 15, 15' as well as two supports 16 and two nozzles 14.

Figure 25:
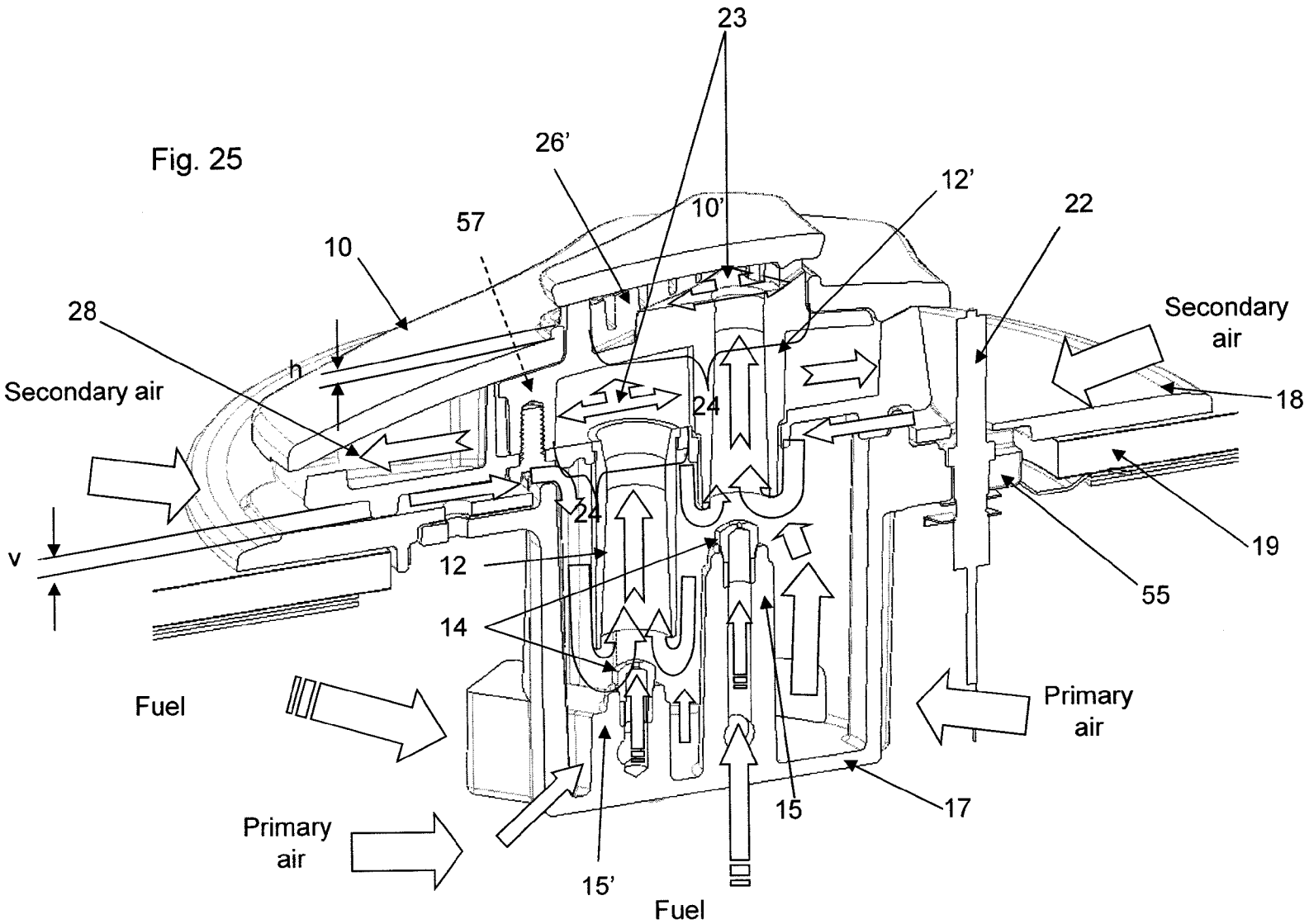
FIG. 25 is a cross section view of the burner in FIG. 19, which shows the fluid flow.
Figure 26A:
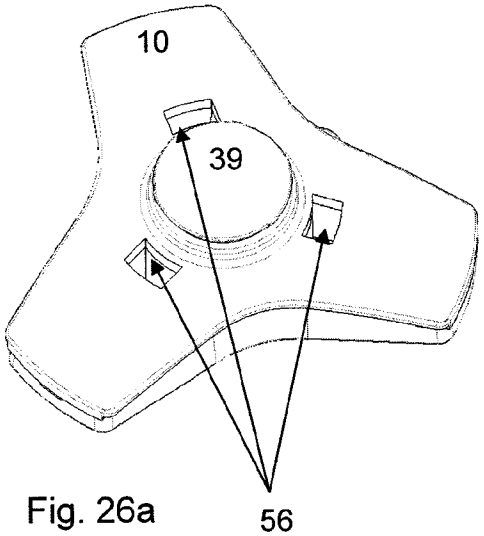
FIG. 26*a* is yet another embodiment of the burner of the present invention.
Figure 26B:
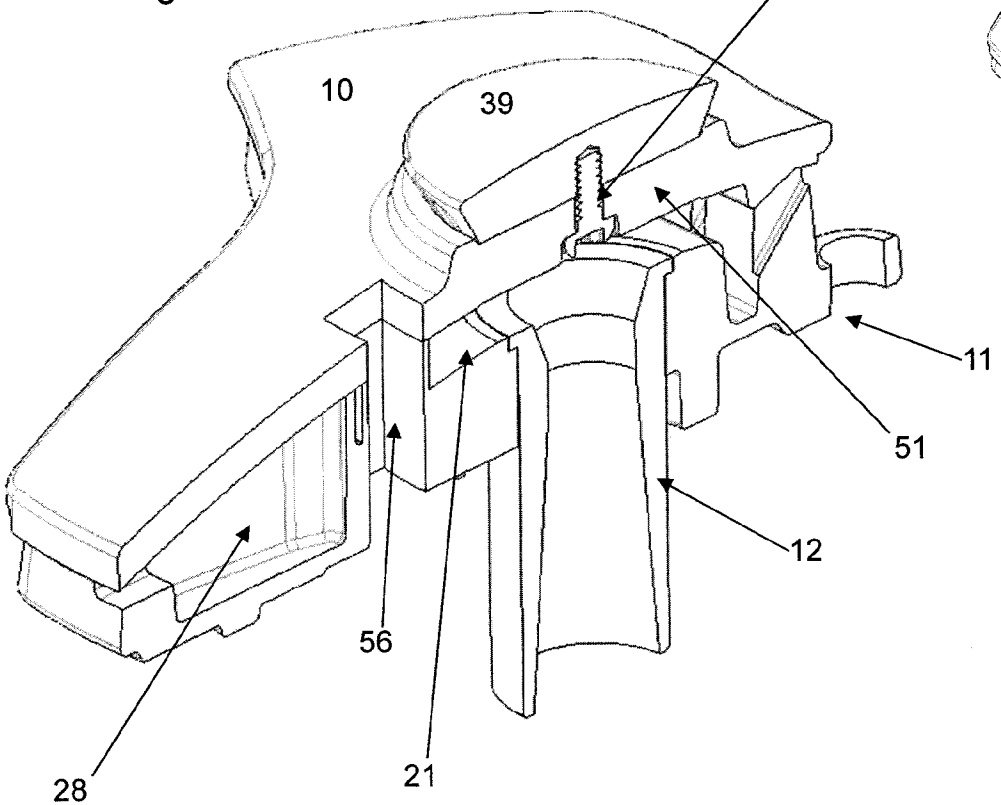
FIG. 26*b* is a cross section view of the embodiment in FIG. 26*a*.

Mechanism for Aspiration and Distribution of the Mixture in the Tandem Burner Embodiment FIG. 25 shows the route followed by the combustible, the air and the mixture within the burner 25 in the present embodiment. Thus, similar to previous embodiments, the primary air enters below the lower face of the body of the burner 11. It should be highlighted that in a preferred embodiment to the one presently being discussed, the burner assembly 25 may not be set with a diffuser plate 18. Thus, the primary air runs below the lower face of the burner 11, thanks to height "v" set by the feet 31, to be guided towards the cup' 17 lower or middle part. Said cup 17 itself has in its lower part a pair of mini-connectors 15, 15' and nozzles 14 with independent entries for the combustible, which is injected towards the Venturi tubes 12, 12' respectively. Precisely in the vicinity of the lower part of said Venturi tubes 12, 12' the primary air is suctioned due to the venturi effect formed in the Venturi tubes 12, 12', because the combustible is injected by means of the nozzles 14, thus the mixture of the primary combustible air is dragged through the Venturi tube 12 and directed towards the discharge zone 24 within the mixture chamber 23 of the body of the burner 11. It should be remembered that the chamber of the body of the burner 11 in this embodiment is bound in its upper part by the mask 57, which seals the entire periphery of the chamber of the body of the burner 11, only allowing the mixture's exit through the port ducts 20 (or in an alternative embodiment it also allows the mixture's exit through the secondary ports 42 which are found on the crenellates 46). It can also be set with some transferring grooves 49 which allow the mixture to pass towards the stability chamber 28 found on the vertexes 27; similar to the previous embodiments the vertexes 27 may have one or several ports 36 or 37. On the other hand, the Venturi tube 12' suctions the primary air thanks to the mixture's velocity which is directed towards its interior, thus the mixture is directed towards the discharge zone 24' of the central burner 39, which in a preferred embodiment to the one presently being discussed, comprises a platform 21' and a channel 35' whose function is equal to or similar to the one already discussed for the platform 21 and channel 35 of the body of the burner 11 for the embodiment which lacks the stability chambers; with the end purpose of avoiding repetition, said functionality, design, geometry and additional considerations are fully described; thus by means of this mechanism the mixture reaches the ports 20' of the crenellated walls 26' which are covered by the lid 10', in the same manner as exists for the body of the burner 11.

An alternative embodiment to all of the ones described above is shown in FIGS. 26*a*, 26*b* where on the lid 10 it is possible to have at least one vertical conduit 56 which traverses the body of the burner 11 to transport the air found in the lids' 10 vicinity towards the lower face of the body of the burner 11, to thus deliver primary air to the suctioning mouth of the Venturi tube 12.

Alterations to the structure described in the present document could be foreseen by those with expertise in the field. However, it should be understood that the present description is related with the preferred embodiments of the invention, which are solely for illustrative purposes, and should not be construed as a limitation of the invention. All modifications which do not part from the spirit of the invention shall be included within the body of the attached claims.

Having described the invention in sufficient detail, it is found to have industrial applicability by being manufacturable and adaptable for grills, stoves or kitchens for household use, as well as having undergone the previous art study and that which emerges from the present specification, is found to have a high degree of inventive activity so that the following are being claimed.

The invention claimed is:

1. A polygonal gas burner for household equipment comprising:

a) a body of the burner formed by sides which are formed by at least one crenellated wall, each side with ends;

vertexes which join the crenellated walls on one of the side ends of the side;

a zone for the mixture of combustible gas with primary air to form an air-gas mixture;

an inner chamber with an inner table;

a zone with divergent ports with main ports on an upper face of the crenellated wall, wherein the main ports comprise a base and an apex, and wherein said base has an angle $\alpha$ varying from approximately 10° to approximately 60° in relation to the horizontal on the burner; and b) a lid which covers the body of the burner enclosing the inner chamber and allows the passage of the mixture through the main ports;

wherein the lid comprises a lower surface and at least two peripheries, each periphery forming one side;

wherein the lower surface of the lid has a rib per each side of the lid;

wherein the rib and the apex of the main ports have in angle $\delta$ varying from approximately 1° to approximately 60° in relation to the horizontal on the burner;

wherein the lid is formed by a first curved surface on the horizontal plane and a second curved surface on the vertical plane which cuts on the at least one side of the first curved surface; and wherein close to, or on the border of the sides of the lid, each side comprises a bevel and an extremity substantially parallel to the rib.

2. The burner according to claim 1, wherein:

the main ports are substantially centric in relation to the ends on each side;

the ports have an equidistant space between each other;

each side is formed by at least first and second curved surface, wherein the curved surfaces are intersected by each other;

the first curved surface of the sides is on the horizontal plane and is in domed or spherical shape; and the second curved surface of the sides is on the vertical plane, wherein the second curved surface has a β inclination varying from approximately 1° to approximately 25° and wherein the second curved surface has a truncated cone, dome or parabolic shape.

3. The burner according to claim 1, wherein the inner table is a platform, wherein the platform comprises two curved surfaces which are intersected, a first curved surface on a horizontal plane and a second curved surface on the vertical plane which cuts on the at least one side of the first curved surface, and where a channel parallel to the wall of the burner is formed and which separates the platform from the burner's wall.

4. The burner according to claim 3, wherein the vertexes comprise at least one secondary port with a base which allows for the transport of flame between the main ports of a first side and the main ports of a second side, and wherein between the platform and the vertex the burner is comprised of a stability chamber with a periphery which has at least one transference groove which allows for the passage of the air-gas mixture from the inner chamber towards the inner part of the stability chamber.

5. The burner according to claim 1, wherein the burner comprises a diffuser plate, and wherein the diffuser plate comprises:

at least one centering rib which allows the diffuser plate to center in relation to the equipment for household use; and a channel which allows for the housing of al, closure or packaging.

6. The burner according to claim 1, wherein the mixture zone comprises:

a cup whose lower part houses a mini-connector and it in turn houses a nozzle which directs the combustible gas towards the mixture zone; and a Venturi tube which communicates the inner chamber to the mixture zone; where between the nozzle and the Venturi tube there is a space which allows the mixture of a primary air with the combustible gas.

7. The burner according to claim 6, wherein the cup has grooves or windows in a lower part which allow the flow of primary air from the lower outer part towards the inner cup.

8. The burner according to claim 6, wherein the lower plate with extremities is grasped unto the cup, wherein the lower plate's extremities contain resilient rubbers, wherein the resilient rubbers make contact with the equipment for household use.

9. The burner according to claim 1, wherein on the lid, there is at least one vertical conduit which traverses the burner to transport air which is found nearby the lid towards a lower face of the burner.

10. The burner according to claim 1, wherein the lid is set with a cavity, where the vertexes comprise at least one secondary port with a base which allows for the transport of flame between the main ports of a first side and the main ports of a second side, and wherein the inner table and the vertex of the burner comprise a stability chamber with a periphery which has at least one transference groove which allows for the passage of the air-gas mixture from the inner chamber towards the inner part of the stability chamber, the burner comprises:

a central burner with a lower part placed in the lid's cavity, the central burner with sides which are formed by at least one crenellated wall and two ends, on each end of the side a vertex is formed, the central burner comprises an inner chamber with an inner table;

a mask which comprises some openings which have the same contour as that of an inner wall of the stability chamber, wherein the mask of the central burner is the inner table of the burner, wherein the mask bumps into and is seated over the port zone of the burner, a port zone divergent from the main ports on an upper face of the crenellated wall of the central burner;

a lid which encloses the inner chamber of the central burner and allows the passage of the mixture through the main ports of the central burner;

wherein the main ports of the central burner are substantially centric regarding each side's ends.

11. A polygonal gas burner for household equipment comprising:

a) a body of the burner formed by sides which are formed by at least one crenellated wall, each side with ends;

vertexes which join the crenellated walls on one of the side ends of the side;

wherein the vertexes comprise at least one secondary port with a base which allows for the transport of flame between the main ports from a first side to the main ports of a second side, where the base of the secondary port has an angle varying approximately between 0° and 10°;

a zone for the mixture of combustible gas with primary air to form an air-gas mixture;

an inner chamber with an inner table;

a zone with divergent ports with main ports on an upper face of the crenellated wall; and b) a lid which covers the body of the burner enclosing the inner chamber and allows the passage of the mixture through the main ports;

wherein between the inner table and the vertex, the burner comprises a stability chamber with a periphery, wherein the inner table comprises a discharge zone for the air-gas mixture and wherein the stability chamber is far away from the discharge zone, wherein on the periphery of the stability chamber there is at least one transferring groove which allows the passage of the air-gas mixture from the inner chamber towards the exterior of the stability chamber, wherein the stability chamber is capable of guarding the air-gas mixture with low or null velocity and consequently a flame within the burner, and wherein the secondary ports have a port area varying approximately between 5 $mm^2$ to 30 $mm^2$ and where the stability chamber has a shape similar to that of an irregular pentagon or elongated horseshoe.

12. The burner according to claim 11, wherein the lid is set with a cavity with a periphery, where the vertexes comprise at least one secondary port with a base which allows the transport of flame between the main ports of one side to the main ports of the second side, wherein the base of the secondary port has an angle varying from approximately 0° to approximately 10°, wherein between the inner table and the vertex, the burner comprises a stability chamber with a periphery, wherein the inner table comprises a discharge zone for the air-gas mixture and wherein the stability chamber is distant from the discharge zone, wherein on the periphery of the stability chamber at least one transferring groove is found which allows for the passage of the air-gas mixture from the inner chamber towards the outer area of the stability chamber, wherein the stability chamber is capable of guarding the air-gas mixture with low or null velocity and consequently a flame within the burner, and wherein the stability chamber has a shape similar to that of an irregular pentagon or elongated horseshoe, and where the burner comprises:

a central burner with a lower part, placed on the lid's cavity, the central burner comprises:

an inner chamber of the central burner with at least two peripheries which form at least two sides of the central burner, each side with two ends, wherein at least one vertex is formed on each extreme of the sides and wherein each side is formed by at least two curved surfaces intersected to each other;

a mask with ends which comprises some openings on its ends, wherein the openings on the ends of the mask have the same contour as an inner wall of the stability chamber, wherein the mask of the central burner is the inner table of the burner, wherein the mask bumps and sits on a back spine found in the port zone of the burner, wherein the lower part of the mask, the central burner comprises posts to support and grant distance to an inner face of the inner chamber of the burner and the lower part of the mask, a port zone on each side of the central burner which comprises main ports, wherein the symmetry axis of each one of the main ports of the central burner is aligned towards the end nearest to each one of the main ports of the central burner and where the main ports of the central burner have an equidistant space between each other;

a lid which closes the inner chamber of the central burner and allows the passage of the mixture through the main ports of the central burner;

wherein the mixture zone comprises:

a cup whose lower part houses a first and second mini-connector and it in turn a first and second nozzle which directs the combustible gas towards the mixture zone, and a first Venturi tube which communicates the inner chamber to the mixture zone, wherein between the first nozzle and the first venture tube there is a space which allows the mixture of a primary air with the combustible gas, a second Venturi tube which communicates the burner's inner chamber to the mixture zone, wherein between the second nozzle and the second Venturi tube there is a space which allows the mixture between a primary air and the combustible gas.

13. The burner according to claim 12, wherein a first curved surface of the sides is over the horizontal plane and wherein a second curved surface of the sides is over the vertical plane, wherein the second curved surface has an β inclination varying from approximately 1° to approximately 25°.

14. The burner according to claim 12, wherein the mask comprises two curved surfaces which intersect, a first curved surface over a horizontal plane and a second curved surface over a vertical plane which cuts on the at least one back spine of the first curved surface said first curved surface and where a channel is formed parallel to the burner's wall, and which separates the platform from the burner's wall.

15. The burner according to claim 12, wherein the main ports and the ports of the central burner comprise a base and an apex, and wherein said base has an angle α varying from approximately 10° to approximately 60° in relation to the horizontal on the burner.

16. The burner according to claim 15, wherein the lid and the lid of the central burner comprise a lower surface and at least two peripheries, each periphery forming one side, wherein the lower surface of the lid and of the central lid have a rib per each side of the lid and per each side of the central lid, wherein the rib and the apex of the main ports and the ports of the central lid have an angle ð varying from approximately 1° to approximately 60° in relation to the horizontal on the burner, wherein the lid and the central lid are formed by a first curved surface on the horizontal plane and a second curved surface on the vertical plane which cuts on the at least one side of the first curved surface said first curved surface, and wherein close to, or on the border of the sides of the lid and the central lid, each side comprises a bevel and a extremity substantially parallel to the rib.

17. The burner according to claim 12, wherein on the lid, there is at least one vertical conduit which traverses the burner to transport air which is found nearby the lid towards a lower face of the burner.

18. A polygonal gas burner for household equipment comprising:

a) a body of the burner formed by sides which are formed by at least one crenellated wall, each side with ends;

vertexes which join the crenellated walls on one of the side ends of the side;

a zone for the mixture of combustible gas with primary air to form an air-gas mixture;

an inner chamber with an inner table;

a zone with divergent ports with main ports on an upper face of the crenellated wall; and b) a lid which covers the body of the burner enclosing the inner chamber and allows the passage of the mixture through the main ports, wherein the lid is set with a cavity with a periphery and wherein the burner comprises:

a central burner with ports placed in the lid's cavity, wherein between the central burner and the lid, a separator ring is placed, wherein the separator ring supports the central burner and elevates the central burner from an upper face of the lid's, wherein the ports of the central burner have a β inclination varying approximately from 1° to 25°, wherein the flame darts of the central burner may ignite the darts produced in the main ports close to the central burner, without the darts of the central burner and the darts of the main ports, once the burner and the central burner are ignited, touch each other, collide or collapse unto other, wherein the cavity of the lid is substantially centric as regards the lid, wherein the cavity is comprised of a beam with an upper part which crosses the cavity diametrically, through which a fastening means is placed which grasps and centers the central burner in relation to the cavity and where a lower face of the central burner has a diametrical groove which houses the beam's upper part, a slice section which covers the central cavity, where the slice section regulates the mass flow of the air-gas mixture towards the ports of the central burner, wherein said slice section follows the curved surface which describes the lid or the inner table, wherein between the slice section and the periphery of the cavity there is a vertical distance approximately varying between 0.5 mm and 5 mm, and wherein the vertical distance between the slice section and the periphery of the cavity is achieved by means of a block set on the lower face of the lid or by means of a protruding neck on the beam's center.

* * * * *